United States Patent [19]

Aoki et al.

[11] Patent Number: 4,770,988

[45] Date of Patent: Sep. 13, 1988

[54] SILVER HALIDE COLOR PHOTOGRAPHIC MATERIAL WITH COMBINATION OF PHENOLIC COUPLETS

[75] Inventors: Kozo Aoki; Minoru Sakai, both of Kanagawa, Japan

[73] Assignee: Fuji Photo Film Co., Ltd., Kanagawa, Japan

[21] Appl. No.: 77,465

[22] Filed: Jul. 24, 1987

[30] Foreign Application Priority Data

Jul. 24, 1986 [JP] Japan ..... 61-172804

[51] Int. Cl.[4] ..... G03C 7/34

[52] U.S. Cl. ..... 430/548; 430/549; 430/552; 430/553

[58] Field of Search ..... 430/548, 549, 552, 553, 430/558 R

[56] References Cited

U.S. PATENT DOCUMENTS

| | | | |
|---|---|---|---|
| 3,311,476 | 3/1967 | Loria | 430/553 |
| 4,327,173 | 4/1982 | Aoki et al. | 430/558 |
| 4,430,423 | 2/1984 | Aoki et al. | 430/558 |
| 4,564,586 | 1/1986 | Aoki et al. | 430/552 |
| 4,666,826 | 5/1987 | Takada et al. | 430/549 |

*Primary Examiner*—Richard L. Schilling

*Attorney, Agent, or Firm*—Sughrue, Mion, Zinn, Macpeak & Seas

[57] ABSTRACT

A silver halide color photographic material containing the combination of cyan couplers of formula (I) and cyan couplers of formula (II). The photographic material provides a dye image excellent in fastness and color reproducibility and free from white background stains. The photographic material undergoes substantially no reduction in density even when processed with a bleaching solution with weak oxidizing capacity or a fatigued bleaching solution.

11 Claims, No Drawings

SILVER HALIDE COLOR PHOTOGRAPHIC MATERIAL WITH COMBINATION OF PHENOLIC COUPLETS

FIELD OF THE INVENTION

This invention relates to a silver halide color photographic material containing a novel cyan dye forming coupler.

BACKGROUND OF THE INVENTION

Dye image formation in silver halide light-sensitive materials is effected by exposure to light and color development processing in which a developing agent, e.g., an aromatic primary amine, oxidized with silver halide is reacted with a dye forming coupler. In this image formation system, color reproduction is generally achieved by a subtractive color process, in which blue, green, and red colors are reproduced by forming their complementary colors, i.e., yellow, magenta, and cyan dyes, respectively.

Cyan dye forming couplers widely employed include phenol couplers and naphthol couplers. However, dye images obtained from the conventionally employed phenol and naphthol couplers have some remaining unsolved problems of preservability. For example, dye images obtained from 2-acylaminophenol cyan couplers as described in U.S. Pat. Nos. 2,367,531, 2,369,929, 2,423,730 and 2,801,171, etc. are generally inferior in fastness to heat; those obtained from 2,5-diacylaminophenol cyan couplers as described in U.S. Pat. Nos. 2,772,162 and 2,895,826 are generally inferior in fastness to light; and those obtained from 1-hydroxy-2-naphthamide cyan couplers are generally insufficient in fastness to both light and heat, and particularly heat and humidity.

5-Hydroxy-6-acylaminocarbostyril cyan couplers described in Japanese Patent Application (OPI) Nos. 104333/81 and 159861/85 (the term "OPI" as used herein means an "unexamined published Japanese patent application"), and 4-hydroxy-5-acylamino-oxyindole couplers, 4-hydroxy-5-acylamino-2,3-dihydro-1,3-benzimidazol-2-one couplers, etc. described in Japanese Patent Application (OPI) No. 105229/83 are excellent in light- and heat-fastness but have the disadvantage of yellow stain in the white background or unexposed areas.

Some examples of the condensed ring type couplers included in the formula (I) of the present invention and some examples of the 2,5-diacylamino type cyan couplers are disclosed in Japanese Patent Application (OPI) Nos. 22342/86, 11744/86, 171953/84, 166955/84, 185335/84 and 198454/84, but these prior art references do not teach the use of these cyan dye forming couplers in combination.

SUMMARY OF THE INVENTION

One object of this invention is to provide a color photographic material using a cyan dye forming coupler which forms a dye image excellent in fastness and color reproducibility and free from white background stains.

Another object of this invention is to provide a color photographic material which undergoes no reduction in density even when processed with a bleaching solution with weak oxidizing capacity, such as a bleaching solution containing a sodium (ethylenediaminetetraacetato)iron (III) or ammonium(ethylenediaminetetraacetato)iron (III), or a partially exhausted bleaching solution.

It has now been found that these and other objects of the present invention can be accomplished by a silver halide color photographic material composed of a support having thereon at least one light-sensitive layer, the material containing at least one cyan dye forming coupler represented by the following formula (I) and at least one cyan dye forming coupler represented by the following formula (II):

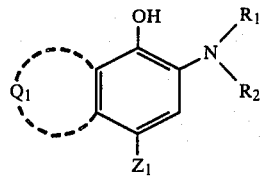

(I)

in which $Q_1$ represents an atomic group necessary for forming a substituted or unsubstituted heterocyclic ring having at least 5-members and containing at least one nitrogen atom; $Z_1$ represents a hydrogen atom or a group releasable upon coupling with an oxidation product of a color developing agent; $R_1$ represents a group bonded to the nitrogen atom by an acyl group or a sulfonyl group; and $R_2$ represents a hydrogen atom or a substituted or unsubstituted aliphatic group having from 1 to 8 carbon atoms, provided that at least two coupler moieties represented by formula (I) may be linked by any of $R_1$, $R_2$, $Z_1$ and $Q_1$ to form a dimer or a higher polymer; and

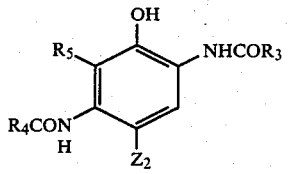

(II)

wherein $Z_2$ has the same definition as $Z_1$ in formula (I); $R_3$ and $R_4$, which may be the same or different, each represents a substituted or unsubstituted aliphatic group, a substituted or unsubstituted aromatic group, a substituted or unsubstituted heterocyclic group, a substituted or unsubstituted aromatic amino group, a substituted or unsubstituted heterocyclic amino group or a substituted or unsubstituted aliphatic oxy group; and $R_5$ represents a hydrogen atom, a halogen atom, an acylamino group, an alkoxy group, an aliphatic group or an aromatic group; provided that at least two coupler moieties represented by formula (II) may be linked by any of $Z_2$, $R_3$, $R_4$ and $R_5$ to form a dimer or a higher polymer.

DETAILED DESCRIPTION OF THE INVENTION

In formula (I), $Q_1$ represents an atomic group necessary for forming a 5- or more-membered nitrogen-containing heterocyclic group, taken together with the two carbon atoms to which it is bonded, preferably 5- to 7-membered heterocyclic group, and, more preferably, 5-membered heterocyclic group. In addition to the nitrogen atom, the ring-forming divalent group includes a divalent amino group; an ether linkage; a thioether linkage; a straight or branched chain alkylene group; a vinylene group; an imino linkage; a sulfonyl group; a carbonyl group; an arylene group; a divalent heterocyclic group; a group represented by formula

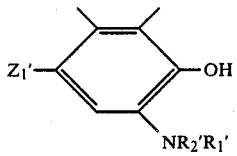

wherein $Z_1'$, $R_1'$, and $R_2'$ which may be the same or different, each has the same definition as $Z_1$, $R_1$ and $R_2$, respectively, provided that $Z_1'$ and $Z_1$, $R_1'$ and $R_1$, and $R_2'$ and $R_2$ may be the same or different; and combinations of these divalent groups. These groups may have substituents as hereinafter recited for $R_7$.

$Q_1$ preferably represents $—NR_6CO—Q_1'$, wherein $Q_1'$ represents a divalent group, including a divalent amino group, an ether linkage, a thioether linkage, a straight or branched chain alkylene group, a vinylene group, an imino linkage, a sulfonyl group, a carbonyl group, an arylene group, a divalent heterocyclic group, a group represented by formula

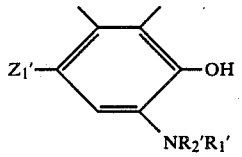

wherein $Z_1'$, $R_1'$ and $R_2'$ are as defined above, and combinations of these divalent groups, which may have substituents as hereinafter recited as for $R_7$; $R_6$ represents a hydrogen atom or a group capable of substituting the nitrogen atom represented by $—X_2—R_8$, wherein $X_2$ represents a chemical bond or a divalent linking group, such as a divalent amino group, an ether linkage, a thioether linkage, an alkylene group, an ethylene linkage, an imino linkage, a sulfonyl group, a sulfoxy group, a carbonyl group, and combinations thereof; and $R_8$ represents an aliphatic group, an aromatic group or a heterocyclic group which may have substituents as hereinafter recited as for $R_7$.

$Z_1$ and $Z_2$ in formulae (I) and (II) each represents a hydrogen atom or a coupling releasable group. Examples of the coupling releasable group include a halogen atom (e.g., a fluorine atom, a chlorine atom, a bromine atom, etc.), an alkoxy group (e.g., an ethoxy group, a dodecyloxy group, a methoxyethylcarbamoylmethoxy group, a carboxypropyloxy group, and a methylsulfonylethoxy group, etc.), an aryloxy group (e.g., a 4-chlorophenoxy group, a 4-methoxyphenoxy group, a 4-carboxyphenoxy group, etc.), an acyloxy group (e.g., an acetoxy group, a tetradecanoyloxy group, a benzoyloxy group, etc.), a sulfonyloxy group (e.g., a methanesulfonyloxy group, a toluenesulfonyloxy group, etc.), an amido group (e.g., a dichloroacetylamino group, a heptafluorobutyrylamino group, a methanesulfonylamino group, a toluenesulfonylamino group, etc.), an alkoxycarbonyloxy group (e.g., an ethoxycarbonyloxy group, a benzyloxycarbonyloxy group, etc.), an aryloxycarbonyloxy group (e.g., a phenoxycarbonyloxy group, etc.), an aliphatic or aromatic thio group (e.g., an ethylthio group, a phenylthio group, a tetrazolylthio group, etc.), an imido group (e.g., a succinimido group, a hydantoinyl group, etc.), an aromatic azo group (e.g., a phenylazo group, etc.), and the like. These releasable groups may contain photographically useful groups, such as those described as "PUG" in U.S. Pat. Nos. 4,146,396, 4,248,962 and 4,409,323.

$R_1$ in formula (I) represents the group $—CO—R_7$ or the group $—SO_2—R_7$. The group $R_7$, and $R_3$ and $R_4$ in formula (II) which may be the same or different, each represents an acyclic or cyclic and substituted or unsubstituted aliphatic group preferably having from 1 to 32 carbon atoms (e.g., a methyl group, a butyl group, a tridecyl group, a cyclohexyl group, etc.), a substituted or unsubstituted aryl group (e.g., a phenyl group, a naphthyl group, etc.), a substituted or unsubstituted heterocyclic group (e.g., a 2-pyridyl group, a 2-imidazolyl group, a 2-furyl group, a 6-quinolyl group, etc.), a substituted or unsubstituted aromatic amino group (e.g., an anilino group, a naphthylamino group, etc.), a substituted or unsubstituted heterocyclic amino group (e.g., a 3-pyridylamino group, a 2-thiazolylamino group, etc.), a substituted or unsubstituted aliphatic oxy group (e.g., an ethoxy group, a hexadecyloxy group, etc.), etc. The substituents for these groups include an alkyl group; an aryl group; a heterocyclic group; and alkoxy group (e.g., a methoxy group, a 2-methoxyethoxy group, etc.); an aryloxy group (e.g., a 2,4-di-t-amylphenoxy group, a 2-chlorophenoxy group, a 4-cyanophenoxy group, etc.); an alkenyloxy group (e.g., a 2-propenyloxy group, etc.), an acyl group (e.g., an acetyl group, a benzoyl group, etc.); an ester group including an alkoxycarbonyl group, an aryloxycarbonyl group, an acyloxy group, an alkoxysulfonyl group, an aryloxysulfonyl group, and a sulfonyloxy group (e.g., a butoxycarbonyl group, a phenoxycarbonyl group, an acetoxy group, a benzoyloxy group, a butoxysulfonyl group, a toluenesulfonyloxy group, etc.); an amido group including an acylamino group, a carbamoyl group, a sulfonamido group, and a sulfamoyl group (e.g., an acetylamino group, an ethylcarbamoyl group, a dimethylcarbamoyl group, a methanesulfonamido group, a butylsulfamoyl group, etc.); a sulfamido group (e.g., a dipropylsulfamoylamino group, etc.); an imido group (e.g., a succinimido group, a hydantoinyl group, etc.); a ureido group (e.g., a phenylureido group, a dimethylureido group, etc.); an aliphatic or aromatic sulfonyl group (e.g., a methanesulfonyl group, a phenylsulfonyl group, etc.); an aliphatic or aromatic thio group (e.g., an ethylthio group, a phenylthio group, etc.); a hydroxyl group; a cyano group; a carboxyl group; a nitro group; a sulfo group; a halogen atom, and the like.

$R_2$ in formula (I) represents a hydrogen atom or a substituted or unsubstituted aliphatic group having from 1 to 8 carbon atoms (e.g., a methyl group, an ethyl group, an isopropyl group, a cyclohexyl group, a 2-ethylhexyl group, an allyl group, etc.). The substituent for the aliphatic group includes those recited for $R_7$.

$R_5$ in formula (II) represents a hydrogen atom, a halogen atom, an acylamino group, an alkoxy group, an aliphatic group or an aromatic group, and preferably a hydrogen atom.

Each of the aliphatic groups described above may have a straight or branched chain structure or a cyclic structure and may be either saturated or unsaturated.

The formulae (I) and (II) may form dimers or higher polymers in which the moieties represented by formulae (I) and/or (II) are connected via a divalent or higher valent group formed by $R_1$, $R_2$, $R_3$, $R_4$, $R_5$, $Z_1$, $Z_2$ or $Q_1$, either individually or in combination. In the case of dimers or polymers, the above-recited carbon atom range for the respective group is not applied.

The polymeric couplers derived from formulae (I) and/or (II) typically include homo- or copolymers containing at least one addition polymerizable ethylenically unsaturated compound (cyan forming monomer) having a cyan dye forming coupler residue derived by removing one hydrogen atom from $R_1$, $R_2$, $R_3$, $R_4$, $R_5$, $Z_1$, $Z_2$ or $Q_1$ of formulae (I) and/or (II), and copolymers containing at least one cyan forming monomer as described above and at least one non-color-forming ethylenically unsaturated monomer. The polymeric couplers may contain both the moieties of formulae (I) and (II) in a single polymer. The polymeric coupler preferably has a molecular weight of about 500,000 or below, and, more preferably, from 3,000 to 50,000. The non-color-forming monomer described at Column 6, line 4 to Column 8, line 27 of U.S. Pat. No. 4,540,654 can be used in the present invention. In these polymers, the repeating unit derived from the cyan forming monomer is represented by formula (T):

(T)

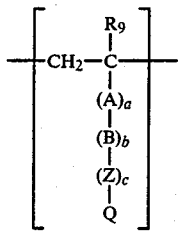

wherein $R_9$ represents a hydrogen atom, an alkyl group having from 1 to 4 carbon atoms or a chlorine atom; A represents —CONH—, —COO— or a substituted or unsubstituted phenylene group; B represents a substituted or unsubstituted alkylene group, a substituted or unsubstituted phenylene group or a substituted or unsubstituted aralkylene group; Z represents —CONH—, —NHCONH—, —NHCO—, —NHCO—, —OCONH—, —NH—, —COO—, —OCO—, —CO—, —O—, —$SO_2$—, —$NHSO_2$— or —$SO_2NH$—; a, b and c, which may be the same or different, each represents 0 or 1; and Q represents a cyan coupler residue derived from the compound of formula (I) or (II) by removing one hydrogen atom from $R_1$, $R_2$, $R_3$, $R_4$, $R_5$, $Z_1$, $Z_2$ or $Q_1$.

In formula (I), $Z_1$ preferably represents a hydrogen atom, a halogen atom, an aryloxy group or an alkoxy group, and more preferably a chlorine atom. The ring formed by $Q_1$ preferably includes a 5- to 8-membered ring, and more preferably a 5- to 7-membered ring. $R_6$ preferably represents a hydrogen atom or an alkyl group, and more preferably a hydrogen atom. $R_1$ preferably represents —CO—$R_7$. $R_2$ preferably represents a hydrogen atom.

Dimers derived from the formula (I) are preferably linked by $Q_1$ or $R_1$, and polymers derived from formula (I) are preferably formed at $Z_1$ or $R_1$, and more preferably at $R_1$.

In formula (II), $R_3$ preferably represents a substituted alkyl group, a substituted or unsubstituted phenyl group or a substituted phenylamino group. $R_4$ preferably represents a substituted or unsubstituted alkyl group or a substituted or unsubstituted phenyl group.

Specific examples of the cyan couplers according to the present invention are shown below, but the present invention is not to be construed as being limited thereto. The ratios given under polymers are by weight.

(I-1)

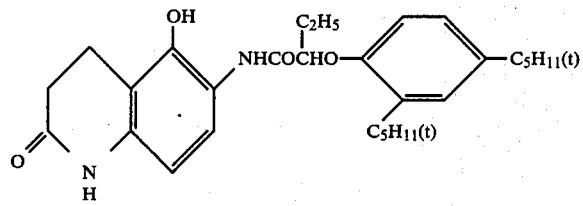

(I-2)

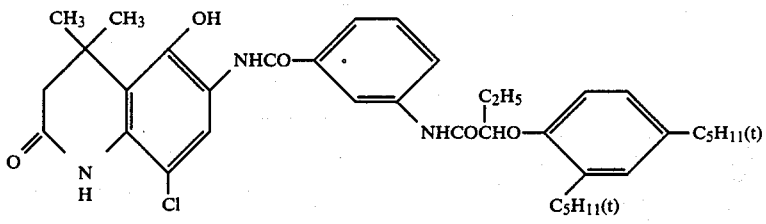

(I-3)

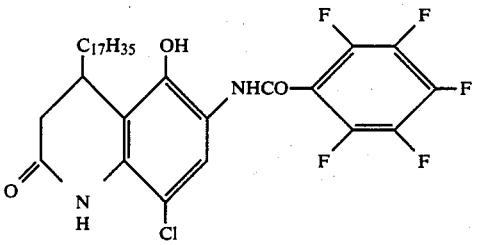

(I-4)

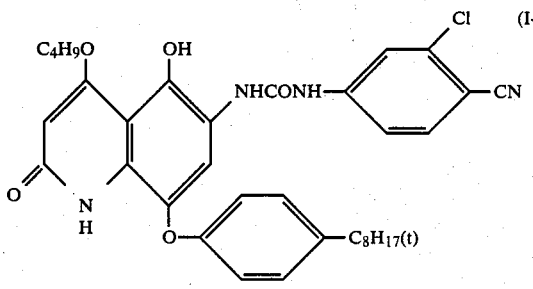

-continued
(I-5)
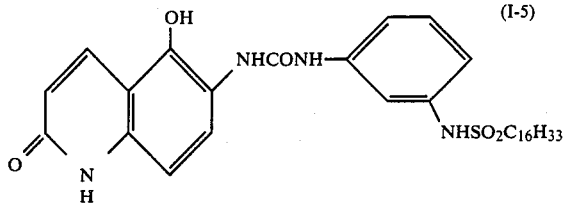
(I-6)
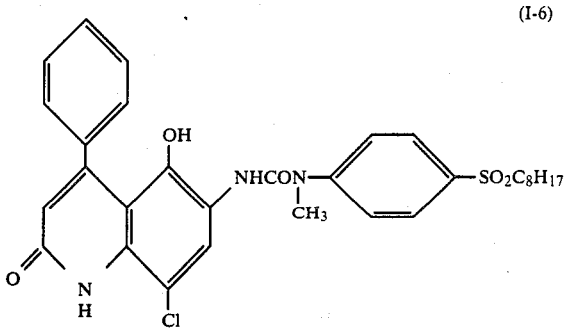
(I-7)
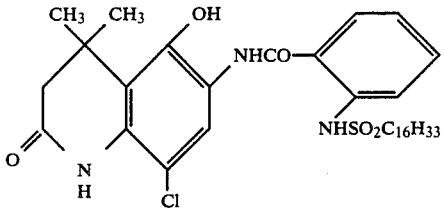
(I-8)
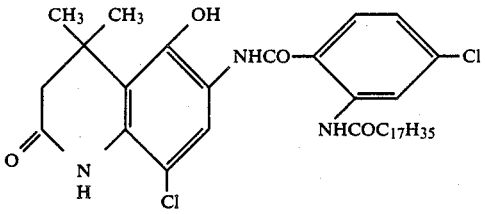
(I-9)
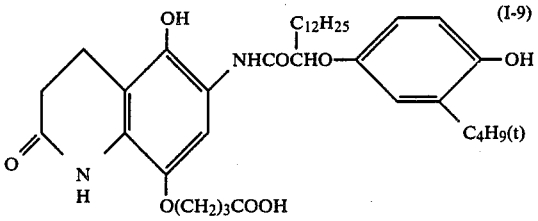
(I-10)
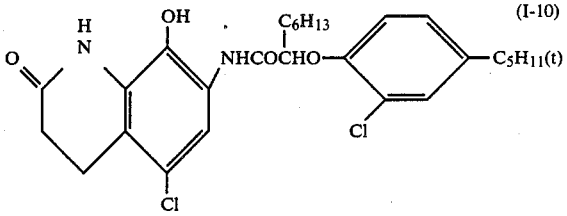
(I-11)
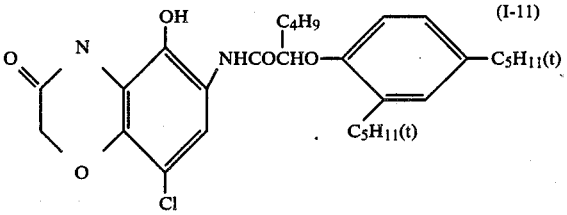
(I-12)
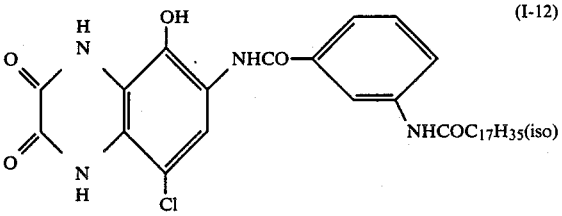
(I-13)
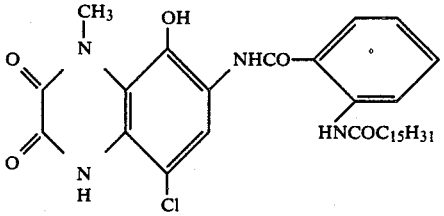
(I-14)
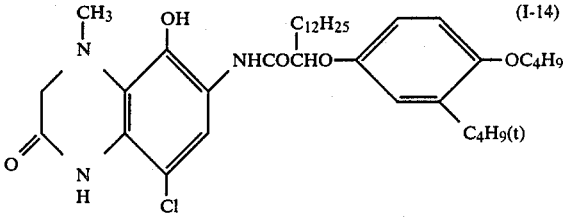
(I-15)
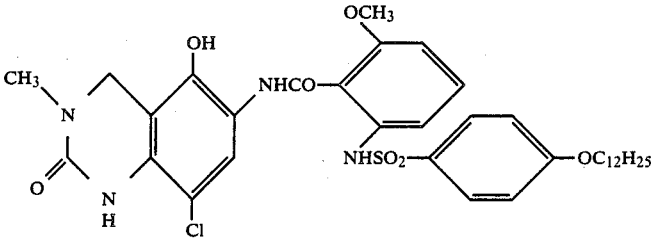

-continued
(I-16)
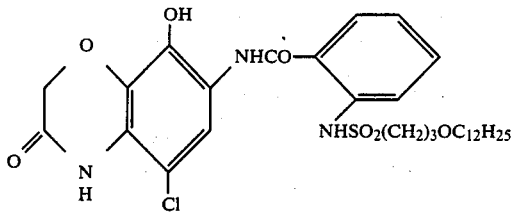
(I-17)
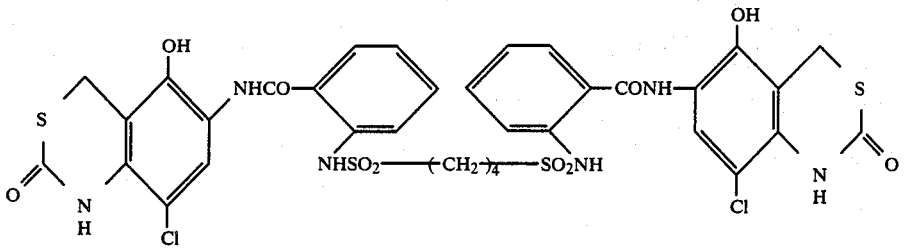
(I-18)
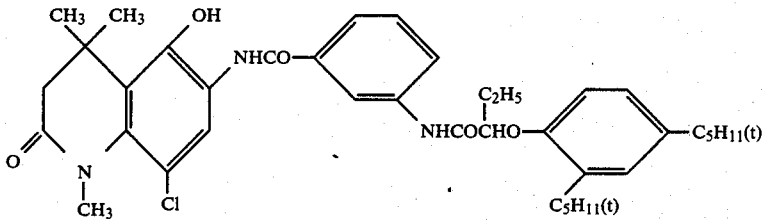
(I-19)
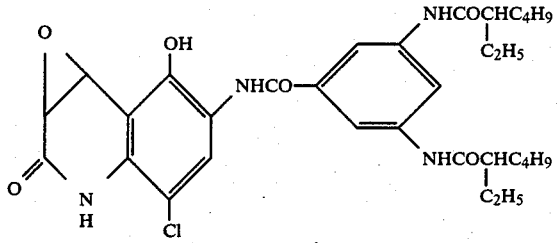
(I-20)
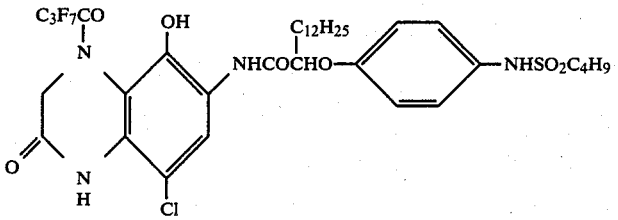
(I-21)
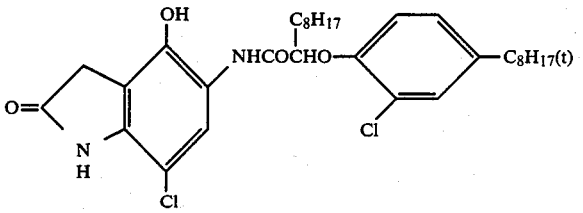
(I-22)
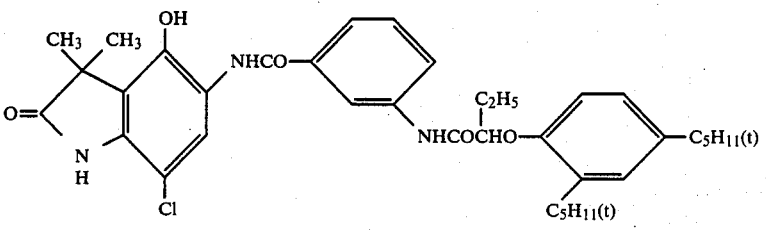

-continued
(I-23)
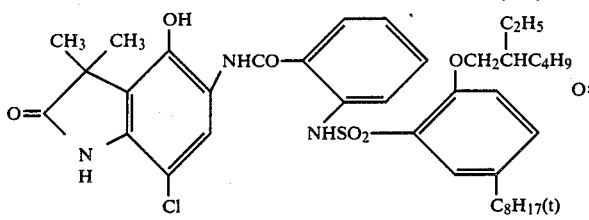
(I-24)
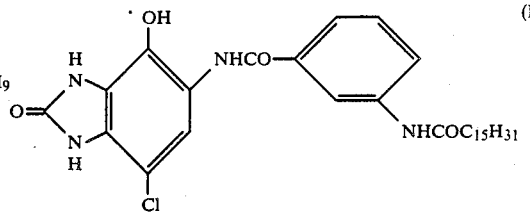
(I-25)
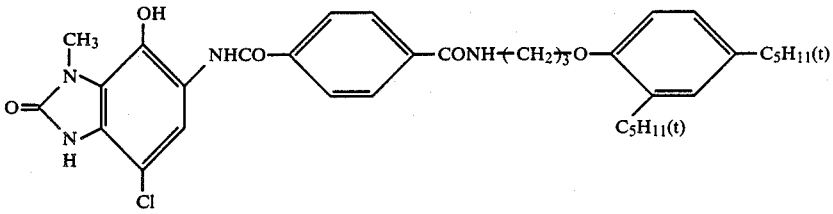
(I-26)
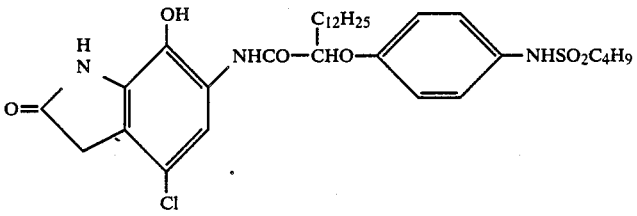
(I-27)
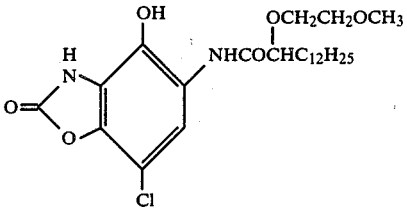
(I-28)
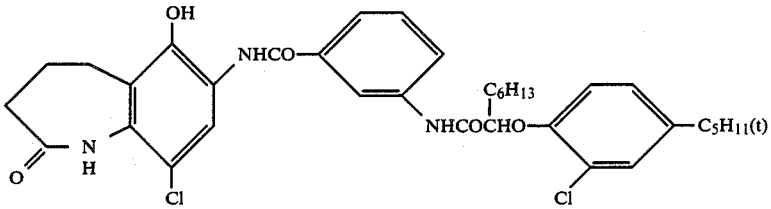
(I-29)
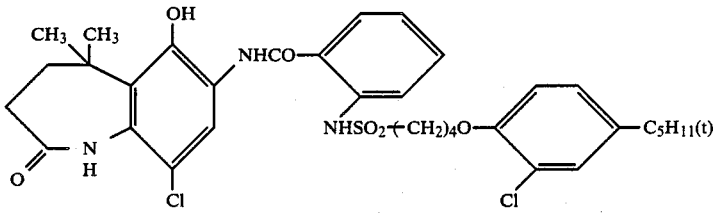
(I-30)
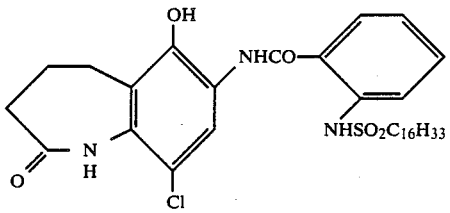
(I-31)
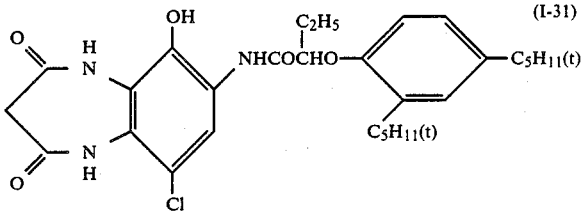

-continued
(I-32)
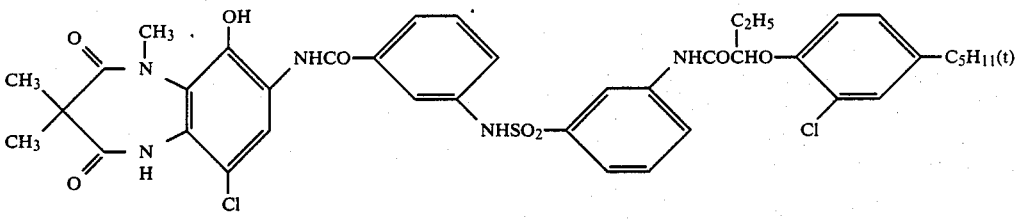
(I-33)
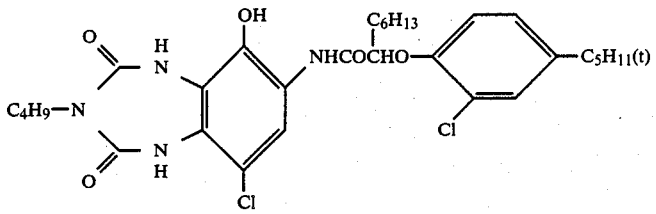
(I-34)
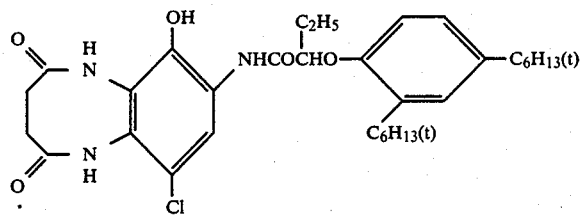
(I-35)
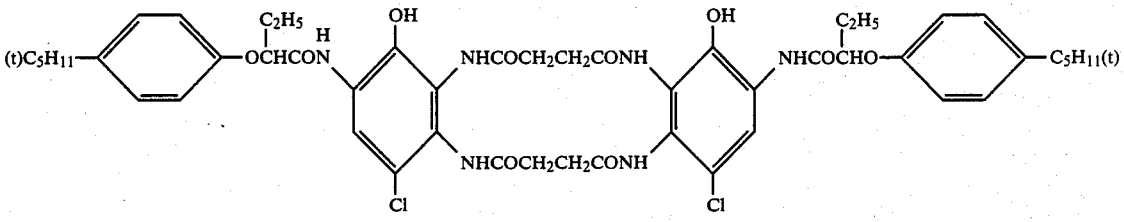
(I-36)
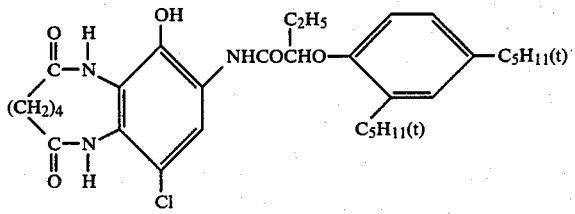
(I-37)
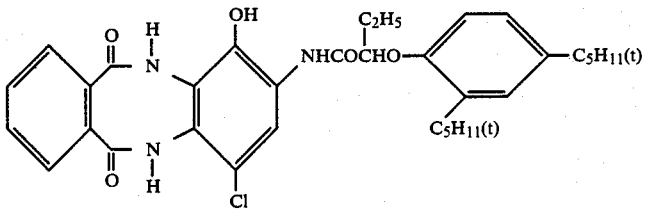
(I-38)
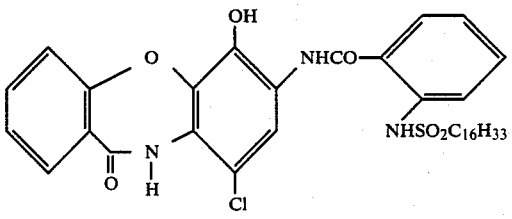

-continued
(I-39)
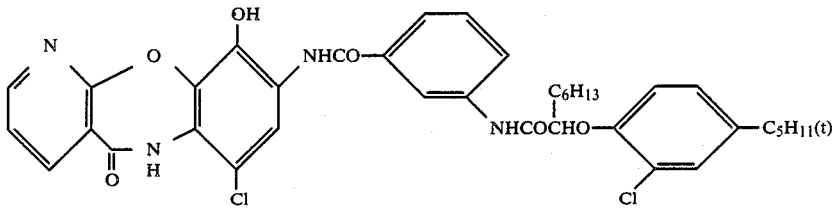
(I-40)
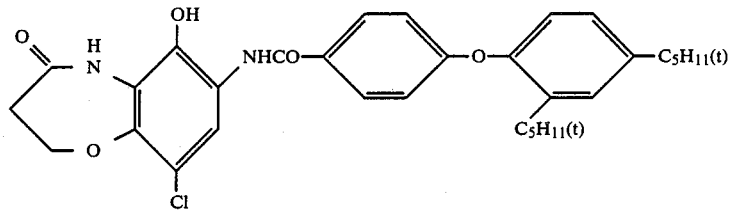
(I-41)
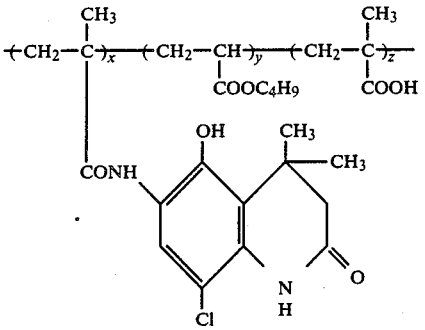
x:y:z = 50:30:20
(I-42)
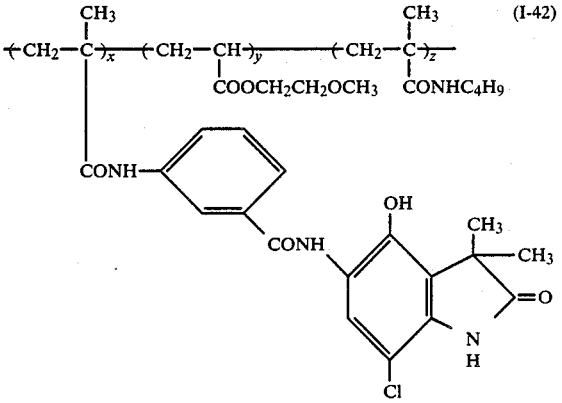
x:y:z = 60:30:10
(I-43)
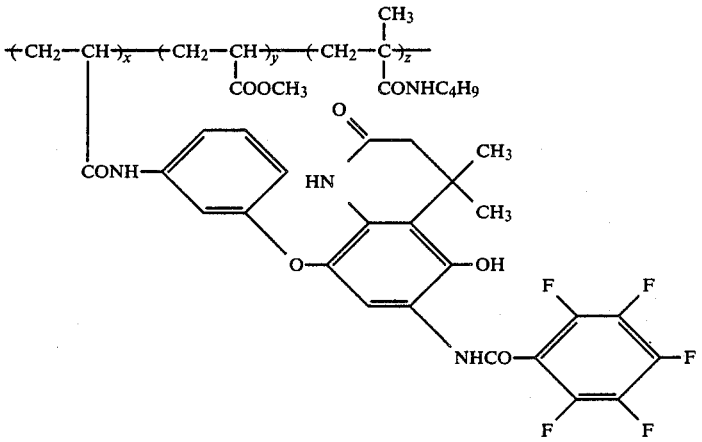
x:y:z = 50:40:10
(I-44)
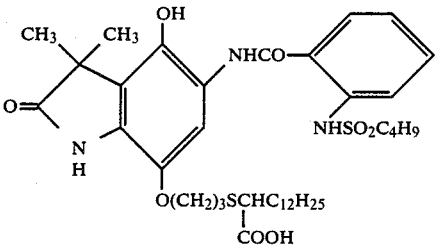
(I-45)
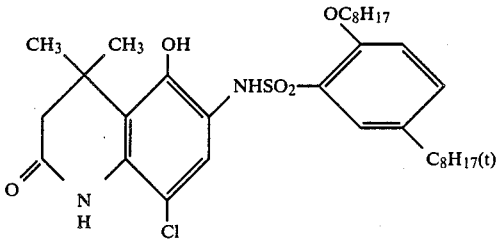

-continued
(I-46)
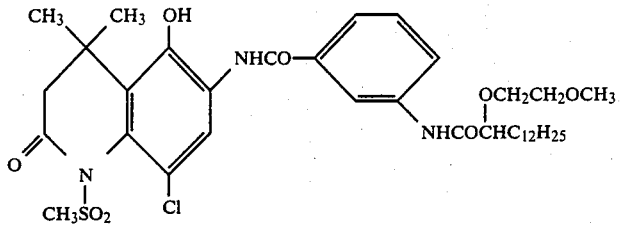
(I-47)
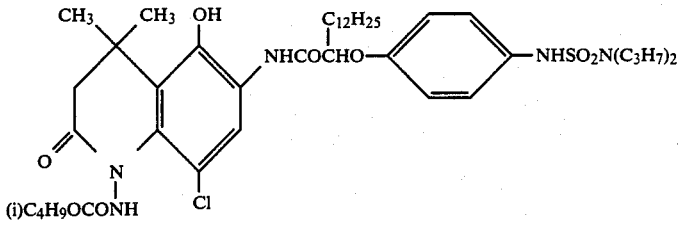
(I-48)
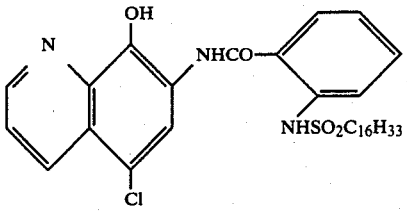
(I-49)
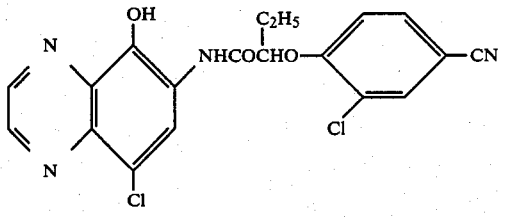
(I-50)
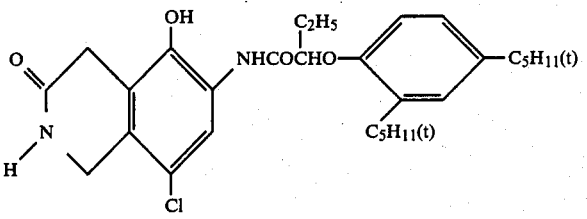
(I-51)
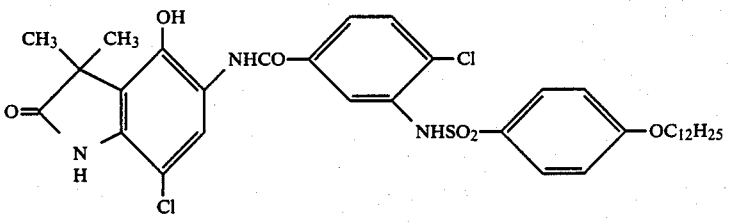
(I-52)
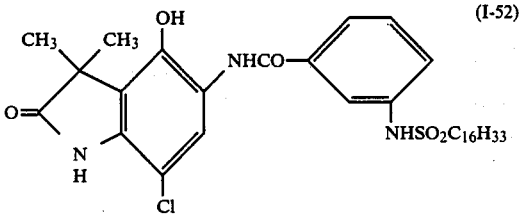
(I-53)
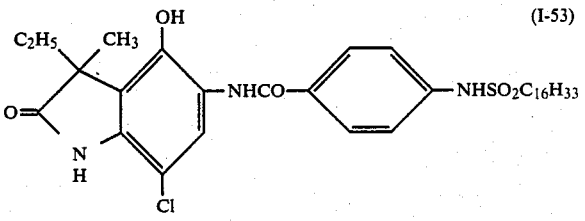
(II-1)
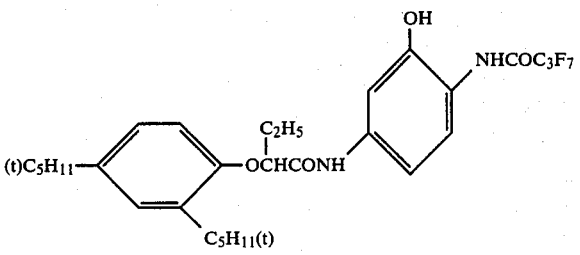

-continued
(II-2)
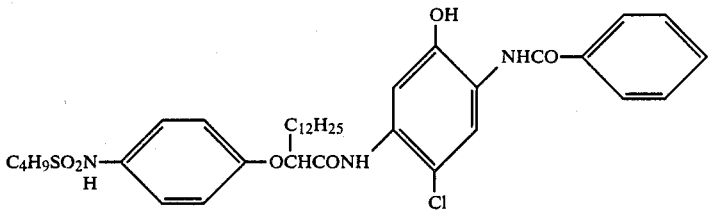
(II-3)
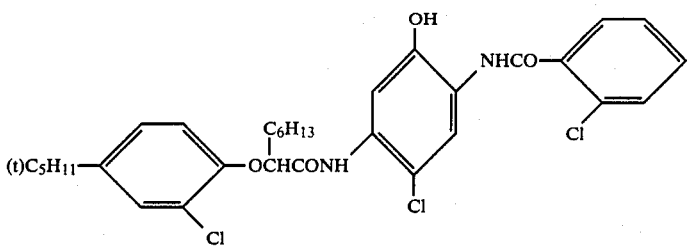
(II-4)
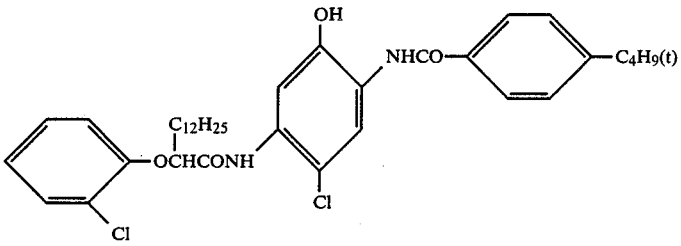
(II-5)
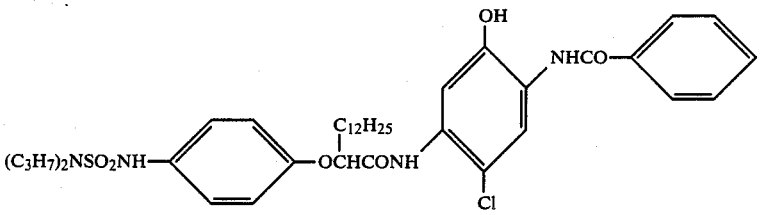
(II-6)
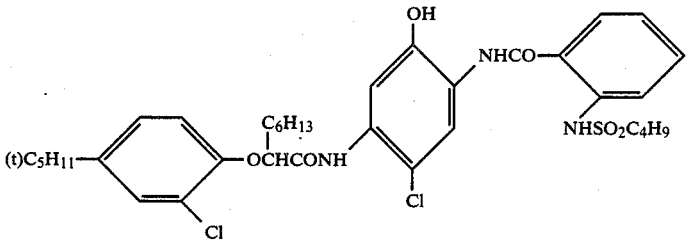
(II-7)
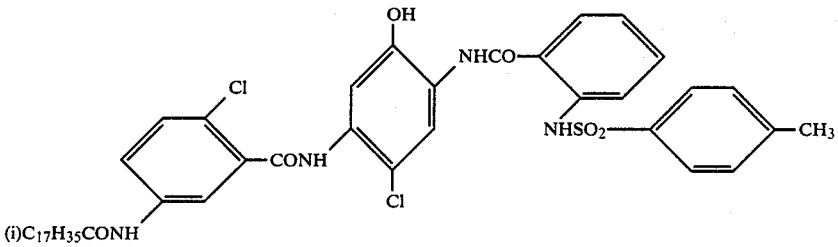

-continued
(II-8)
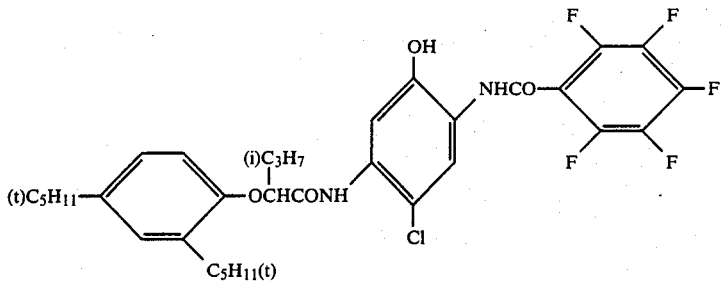
(II-9)
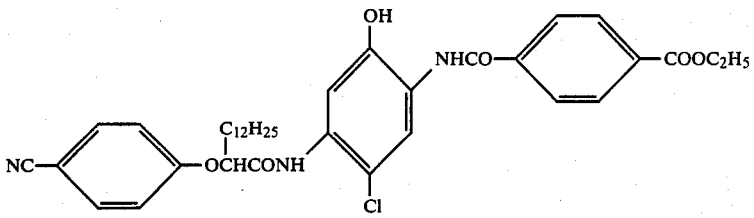
(II-10)
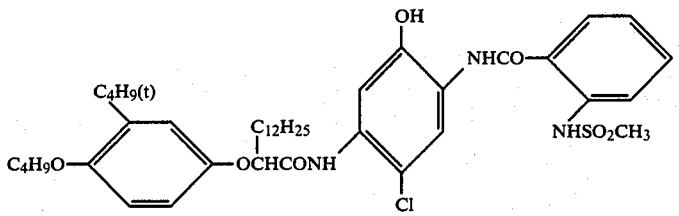
(II-11)
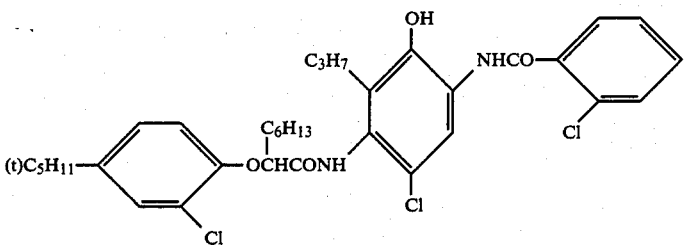
(II-12)
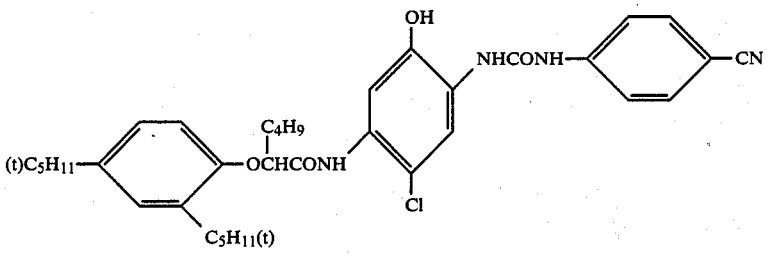
(II-13)
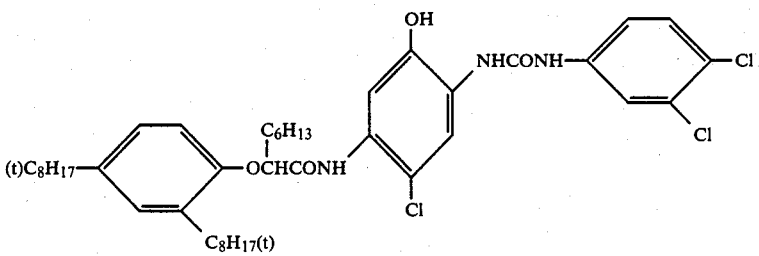

-continued
(II-14)
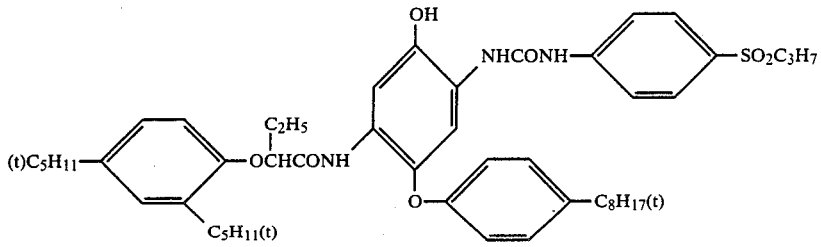
(II-15)
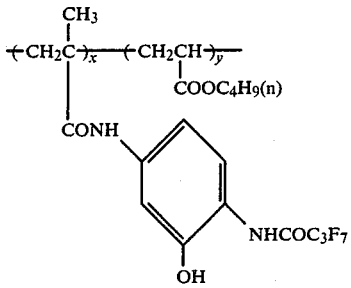
x/y = 60/40
(II-16)
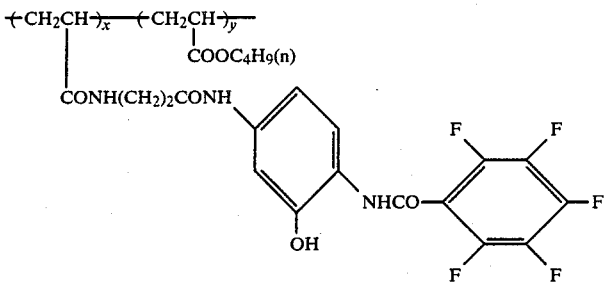
x/y = 50/50
(II-17)
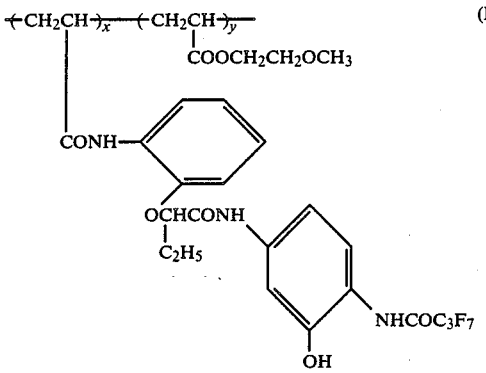
x/y = 60/40
(II-18)
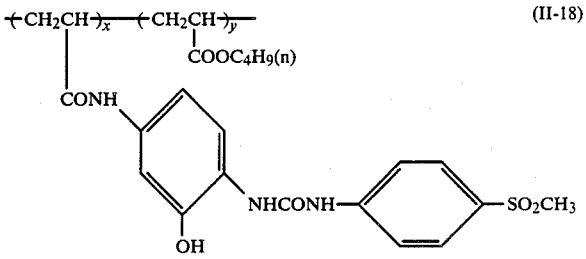
x/y = 50/50
(II-19)
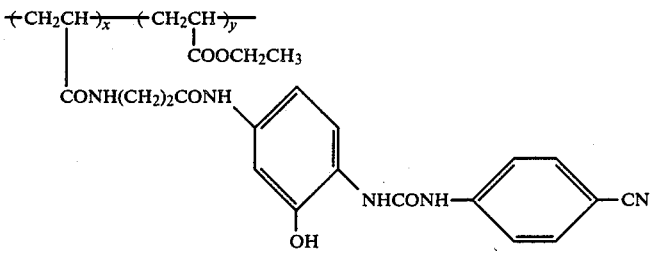
x/y = 45/55
(II-20)
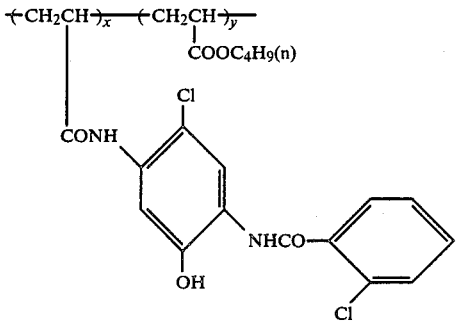
x/y = 50/50

-continued

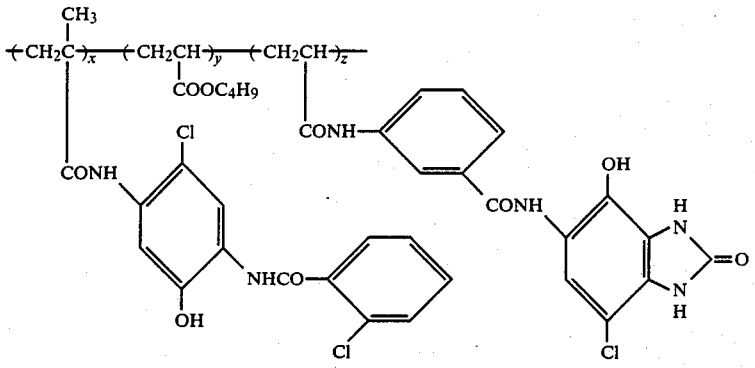

(II-21)

x/y/z = 25/45/30

The cyan couplers represented by formula (I) can be synthesized by known methods as disclosed, e.g., in U.S. Pat. Nos. 4,327,173, 4,430,423 and 4,564,586. The cyan couplers represented by formula (II) can be synthesized by known methods as disclosed, e.g., in U.S. Pat. Nos. 4,513,081, 4,524,132 and 4,333,999. Typical synthesis examples are given below.

SYNTHESIS EXAMPLE 1

Synthesis of 6-[2-(2,4-di-t-Amylphenoxy)Butaneamido]-5-Hydroxy-3,5-Dihydroxycarbostyril [Coupler (I-1)]

(i) Synthesis of 5-Hydroxy-6-Nitro-3,4-Dihydrocarbostyril

In 110 ml of acetic anhydride was dissovled 25 g of 5-hydroxy-3,4-dihydrocarbostyril, and to the solution was added dropwise a mixture of 12 g of fuming nitric acid and 75 ml of acetic acid at 5° C. After stirring at 5° C. for 2 hours, 20 g of ice was added to the reaction mixture, and the precipitated crystals were collected. The crystals were suspended in a 3N sodium hydroxide aqueous solution, followed by filtration. The filtrate was neutralized with hydrochloric acid, and the precipitated crystals were collected by filtration, washed with water, and dried to obtain 22 g of the named compound.

(ii) Synthesis of 6-[2-(2,4-Di-t-Amylphenoxy)butaneamido]-5-Hydroxy-3,4-Dihydrocarbostyril To 22 g of the 5-hydroxy-6-nitro-3,4-dihydrocarbostyril as above prepared were added 100 ml of acetone and 16.3 ml of triethylamine, and 37.7 g of 2-(2,4-di-t-amylphenoxy)butanoyl chloride was added thereto dropwise at room temperature. After stirring at room temperature for 1 hour, 100 ml of ethyl acetate was added thereto. The precipitated triethylamine hydrochloride was removed by filtration, and the filtrate was concentrated under reduced pressure. Recrystallization from hexane gave 34 g of crystals having a melting point of 101° to 105° C. To the resulting crystals were added 150 ml of acetic acid, 70 ml of ethanol, and 30 ml of water, and 32 g of reduced iron was slowly added thereto dropwise with refluxing. Refluxing was continued for an additional one hour, and the reaction mixture was poured into water and extracted with ethyl acetate. The extract was washed with water, and the solvent was removed by distillation under reduced pressure. Recrystallization from acetonitrile gave 26 g of Coupler (I-1) having a melting point of 203° to 205° C.

Elementary Analysis: Found (%): C, 72.45; H, 8.45; N, 5.65 Calcd (%): C, 72.47; H, 8.39; N, 5.83

SYNTHESIS EXAMPLE 2

Synthesis of Coupler (II-3)

(i) Synthesis of 2-(4-t-Amyl-2-Chlorophenoxy)Octanoic Acid

A mixture of 37.2 g of 4-t-amyl-2-chlorophenol, 200 ml of toluene, and 20.4 g of sodium hydroxide was heated to 80° C., and 40.3 g of ethyl 2-bromooctanoate was added dropwise thereto over a period of one hour, followed by reacting the mixture at that temperature for 3 hours. After cooling the mixture with water, 300 ml of water was added thereto, and 40 ml of concentrated hydrochloric acid was dropwise added. The organic layer was separated, washed twice with water, dried over magnesium sulfate, and concentrated under reduced pressure to obtain 55 g of an oily substance.

(ii) Synthesis of Coupler (II-3)

A mixture of 46 g of 2-(4-t-amyl-2-chlorophenoxy)octanoic acid and 46 ml of toluene was heated to 60° C., and 20.3 ml of thionyl chloride was slowly added thereto dropwise while stirring. After allowing the mixture to react at that temperature for 2 hours, the excess thionyl chloride and toluene were removed by distillation under reduced pressure to obtain 48 g of 2-(4-t-amyl-2-chlorophenoxy)octanoic acid chloride.

Separately, 29.7 g of 5-amino-4-chloro-2-(2-chlorobenzoylamino)phenol was suspended in 140 ml of acetonitrile and 70 ml of ethyl acetate, and 38.0 g of 2-(4-t-amyl-2-chlorophenoxy)octanoic acid chloride as prepared above was added dropwise over a period of one hour with heat-refluxing. After refluxing for 5 hours, the reaction mixture was allowed to stand for min. at 20° to 25° C., followed by filtration to obtain 57 g (94% yield) of crystals of Coupler (II-3) having a melting point of 77° to 79° C.

Other couplers of the present invention can be synthesized according to the synthesis examples.

In the photographic material according to the invention, layers containing the cyan coupler of the present invention or other layers having substantially the same color sensitivity may contain other known cyan couplers as described in U.S. Pat. Nos. 2,369,929, 4,518,687, 4,511,647, 3,772,002 and 4,564,590, Canadian Pat. No.

625,822, and Japanese Patent Application (OPI) Nos. 39045/86 and 70846/87. Known cyan couplers which can be used preferably include those represented by formula (III):

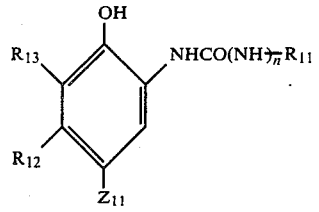

(III)

wherein $R_{11}$ represents a substituted or unsubstituted aliphatic group, a substituted or unsubstituted aryl group or a substituted or unsubstituted heterocyclic group; $R_{12}$ represents a substituted or unsubstituted aliphatic group or a substituted or unsubstituted aryl group; $R_{13}$ represents a hydrogen atom, a halogen atom, a substituted or unsubstituted aliphatic group, a substituted or unsubstituted aryl group, a substituted or unsubstituted alkoxy group, a substituted or unsubstituted aryloxy group or a substituted or unsubstituted acylamino group; $Z_{11}$ represents a hydrogen atom or a group releasable upon oxidative coupling reaction with a developing agent; and n represents 0 or 1.

The cyan couplers represented by formula (III) are preferably used in an amount of from about 5 to 50% by weight based on the total weight of the cyan coupler.

Typical examples of the cyan coupler represented by formula (III) are shown below, but the present invention is not to be construed as being limited thereto.

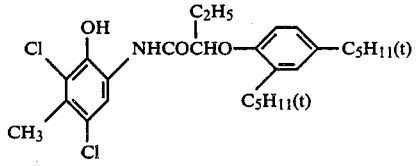

(III-1)

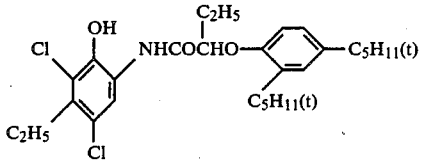

(III-2)

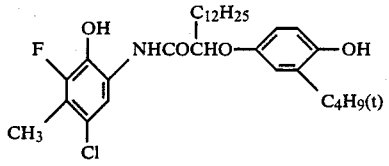

(III-3)

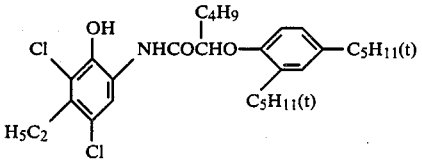

(III-4)

-continued

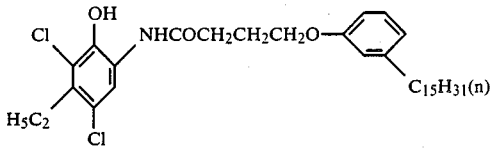

(III-5)

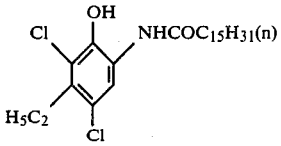

(III-6)

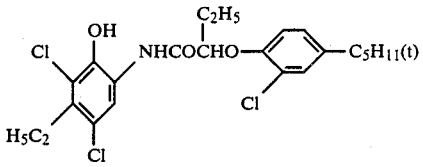

(III-7)

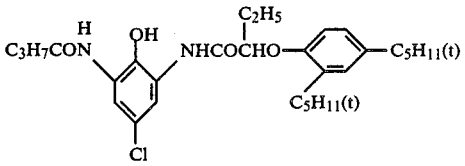

(III-8)

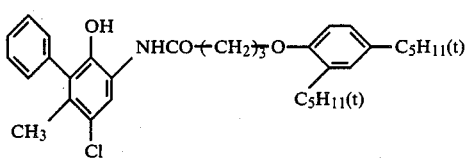

(III-9)

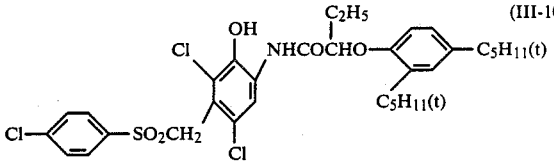

(III-10)

The couplers according to the present invention can be introduced into silver halide emulsion layers in any known manner. A detailed description of solvents for couplers; additives which can be incorporated together with the couplers, such as ultraviolet absorbents, protective colloids, binders, antifoggants, color mixing inhibitors, discoloration inhibitors, sensitizing dyes, dyes, bleaching agents, etc.; techniques for producing silver halide photographic materials including formation of photographic emulsions, introduction of couplers, usable supports, and layer structures; and photographic processing is provided in *Research Disclosure*, No. 17643, Industrial Opportunities Ltd., U.K. (December 1978) and Japanese Patent Application (OPI) Nos. 65134/81 and 104333/81 corresponding to U.S. Pat. Nos. 4,333,999 and 4,327,173, respectively.

The total amount of the cyan couplers of formulae (I) and (II) usually ranges from about 0.1 to 1.0 mol, and preferably from about 0.1 to 0.5 mol, per mol of silver halide in the silver halide emulsion layer(s) to which they are added. The proportion of the coupler of formula (I) to the total amount of coupler (I) and coupler (II) is from about 5 to 95 mol%, and preferably from about 20 to 80 mol%.

In the present invention, the cyan couplers according to the present invention are used in combination with known magenta and yellow couplers.

Typical examples of useful yellow couplers are described in U.S. Pat. Nos. 2,875,057, 2,407,210, 3,265,506, 2,298,443, 3,048,194 and 3,447,928. Of the known yellow couplers, acylacetamide couplers, such as benzoylacetanilide couplers and pivaloylacetanilide couplers, are preferred, including those represented by formulae (IV) and (V):

(VI)

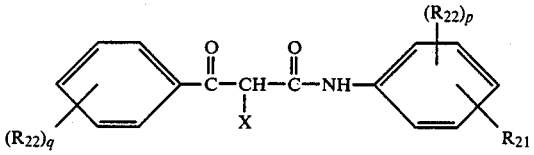

(V)

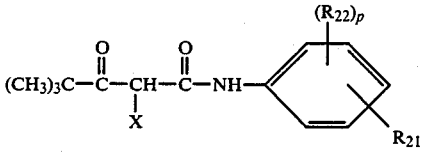

wherein X represents a hydrogen atom or a coupling releasable group [hereinafter the same up to formula (VIII)]; $R_{21}$ represents a nondiffusible group having from 8 to 32 carbon atoms in total; $R_{22}$ represents a hydrogen atom, a halogen atom, a lower alkyl group, a lower alkoxy group or an nondiffusible group having from 8 to 32 carbon atoms in total; p represents an integer of from 1 to 4; and q represents an integer of from 1 to 5, provided that when p or q is 2 or more, the plural $R_{22}$ groups may be the same or different.

Typical examples of usable known magenta couplers are described in U.S. Pat. Nos. 2,600,788, 2,369,489, 2,343,703, 2,311,082, 3,152,896, 3,519,429, 3,062,653 and 2,908,573. Preferred magenta couplers include pyrazolone couplers and pyrazoloazole couplers, such as pyrazolopyrazoles, pyrazoloimidazoles, pyrazolotriazoles, pyrazolotetrazoles, etc. Preferred magenta couplers include those represented by formulae (VI), (VII) and (VIII):

(VI)

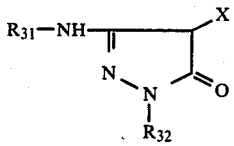

(VII)

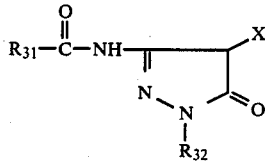

(VIII)

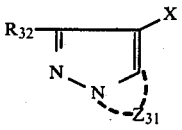

wherein $R_{31}$ represents a nondiffusible group having from 8 to 32 carbon atoms in total; $R_{32}$ represents a halogen atom, a lower alkyl group, a lower alkyl group, a phenyl group or a substituted phenyl group; $Z_{31}$ represents a non-metallic atomic group necessary for forming a substituted or unsubstituted 5-membered azole ring containing from 2 to 4 carbon atoms, including a condensed azole ring; and X is as defined for formulae (IV) and (V) above.

In introducing the cyan, magenta, and yellow couplers into emulsion layers, the coupler is dissolved in a high-boiling organic solvent having a boiling point of about 160° C. or higher and/or a low-boiling organic solvent having a boiling point of from about 30° to 150° C., and the solution is emulsified and dispersed in a hydrophilic colloid aqueous solution. Examples of the high-boiling organic solvent include alkyl phthalates (e.g., dibutyl phthalate, dioctyl phthalate, etc.), phosphoric esters (e.g., diphenyl phosphate, triphenyl phosphate, tricresyl phosphate, dioctylbutyl phosphate, etc.), citric esters (e.g., acetyl tributyl citrate, etc.), benzoic esters (e.g., octyl benzoate, etc.), alkylamides (e.g., diethyllaurylamide, etc.), fatty acid esters (e.g., dibutoxyethyl succinate, dioctyl azelate, etc.), phenols (e.g., 2,4-di-t-amylphenol, etc.), and the like. Examples of the low-boiling organic solvent include lower alkyl acetates (e.g., ethyl acetate, butyl acetate, etc.), ethyl propionate, sec-butyl alcohol, methyl isobutyl ketone, β-ethoxyethyl acetate, methyl cellosolve acetate, and the like.

If desired, the light-sensitive materials of the invention can contain special couplers other than the above-described color couplers. For example, a colored magenta coupler can be added to a green-sensitive emulsion layer to produce a masking effect. Further, both the color-sensitive emulsion layers and layers adjacent thereto can contain a DIR coupler capable of releasing a developing inhibitor or a hydroquinone derivative capable of releasing a development inhibitor. The development inhibitor released from these DIR compounds upon development processing improves sharpness or graininess of a color image or produces interlayer effects, such as improved monochromatic saturation.

Further, a coupler capable of releasing a development accelerator or a nucleating agent upon silver development can be added to a photographic emulsion layer or a layer adjacent thereto to thereby increase photographic sensitivity, graininess, and contrast.

The present invention is applicable to ordinary silver halide color light-sensitive materials, such as color negative films, color papers, color positive films, color reversal films for slides, movies or TV, and the like.

According to a layer structure employed in general color papers, either one or preferably both of two layers adjacent to a cyan coupler-containing red-sensitive emulsion layer contains an ultraviolet absorbent. The ultraviolet absorbent, when incorporated into an intermediate layer between a green-sensitive layer and a red-sensitive layer, may be co-emulsified with a color mixing inhibitor. In cases where the ultraviolet absorbent is added to a protective layer, an additional independent protective layer may be provided as a top layer. This outermost protective layer can contain a matting agent having an arbitrarily determined particle size.

The couplers represented by the formulae (I) and (II) of the present invention, including dimers and polymers thereof, may be incorporated into the same layer or separate layers. These couplers are preferably contained in silver halide emulsion layers, but may be incorporated into the layer adjacent to the silver halide emulsion layer.

Each of the layers of the photographic material is preferably as thinner as possible. A typical order of light-sensitive layers is a blue-sensitive layer, a green-sensitive layer and a red-sensitive layer from the support side, but various modifications are possible in the layer structure, for example, by arranging a green-sensitive layer as a farthermost light-sensitive layer from the support. Also, each of the light-sensitive layers may be composed of a plurality of layers.

The aforesaid ultraviolet absorbent can be incorporated into emulsion layers in the same manner as the couplers. The amounts of the high-boiling organic solvent and the low-boiling organic solvent are not particularly limited. In general, the high-boiling organic solvent is used in an amount up to about 300% by weight based on the ultraviolet absorbent. Solvents which are liquid at ambient temperature are preferably used either individually or in combinations thereof.

The combined used of the cyan couplers according to the present invention and benzotriazole type ultraviolet absorbents is effective to improve preservability, particularly fastness to light, of dye images, particularly a cyan dye image. The benzotriazole ultraviolet absorbent and the cyan coupler can be co-emulsified.

The aforesaid ultraviolet absorbent is added in an amount enought to impart light-fastness to a cyan dye image. Since too large an amount of the ultraviolet absorbent sometimes causes yellowing of unexposed areas (i.e., white background) of color photographic materials, it is generally used in an amount ranging from about $1\times10^{-4}$ to $2\times10^{-3}$ mol/m$^2$, and preferably from about $5\times10^{-4}$ to $1.5\times10^{-3}$ mol/m$^2$.

In order to improve the preservability of dye images, and particularly of yellow and magenta images, various organic or metal complex discoloration inhibitors can be used in combination. The organic discoloration inhibitors include hydroquinones, gallic acid derivatives, p-alkoxyphenols, p-hydroxyphenols, and the like. Dye image stabilizers, stain inhibitors and antioxidants to be used are disclosed in the patents cited in *Research Disclosure,* No. 17643 (December 1978), VII-I to J. Examples of the metal complex discoloration inhibitors are described in Research Disclosure, No. 15162 (November 1976), etc.

For the purpose of improving the fastness of a yellow image to heat and light, various compounds such as phenols, hydroquinones, hydroxychromans, hydroxycoumaranes, hindered amines, and alkyl ethers, silyl ethers or hydrolyzable precursors thereof can be used.

Various silver halides can be used in silver halide emulsion layers of the color photographic materials of the invention. Useful silver halides include silver chloride, silver bromide, silver chlorobromide, silver iodobromide, silver chloroiodobromide, and the like. Of these, preferred are silver iodobromide containing about 2 to 20 mol% of silver iodide and silver chlorobromide containing from about 10 to 50 mol% of silver bromide.

There are no particular limitations on the crystal form, crystal structure, grain size, grain size distribution, etc. of these silver halide grains. For example, the silver halide grains may be normal crystals or twin crystals, and may have any crystal forms, including hexahedral, octahedral, and tetradecahedral forms. Tabular grains having a thickness of about 0.5 μm or less, a diameter of at least about 0.6 μm, and an average aspect ratio of about 5 or more can also be used.

The silver halide grains may have either a homogeneous structure of a heterogeneous structure, such as a coreshell structure, a layered structure, and an epitaxially grown structure having different halogen compositions, or the grains may be a composite of these crystal forms. Further, the grains may be either of surface latent image type or inner latent image type.

The silver halide grains can be fine grains having a diameter of about 0.1 μm or less or large grains having a diameter reaching about 3 μm. The silver halide emulsion may be a monodispersion having a narrow size distribution or a polydispersion having a broad size distribution.

The silver halide emulsions can be prepared and chemically or spectrally sensitized by known methods commonly employed in the art.

The support which can be used in the present invention is selected appropriately from transparent supports, such as a polyethylene terephthalate film and a triacetyl cellulose film, and is preferably a reflective support. The reflective support includes baryta paper, polyethylene-coated paper, polypropylene synthetic paper, transparent support films having a reflective layer or containing a reflective substance, such as a glass plate, a polyvinyl chloride resin, a polyester film (e.g., a polyethylene terephthalate film, a triacetyl cellulose film, a cellulose nitrate film, etc.), a polyamide film, a polycarbonate film, a polystyrene film, etc.

The color photographic materials according to the present invention can further comprise auxiliary layers, such as a subbing layer, intermediate layers, protective layers, and the like. If desired, a second ultraviolet absorbing layer may be provided between a red-sensitive layer and a green-sensitive layer. In this second ultraviolet absorbing layer, the above-described ultraviolet absorbents are preferably used.

Binders or protective colloids to be used in photographic emulsions are not particularly limited, and gelatin can be advantageously used.

If desired, the color photographic material according to the present invention can further contain, in addition to the above-mentioned components, various photographic additives known in the art, such as stabilizers, antifoggants, surface active agents, couplers other than those of the present invention, filter dyes, anti-irradiating dyes, developing agents, and the like. Specific examples of the additives are described in *Research Disclosure,* No. 17643 (December 1978).

In some cases, silver halide emulsion layers or other hydrophilic colloidal layers can further contain a fine silver halide emulsion having no substantial photosensitivity, such as a silver chloride, silver bromide or silver chlorobromide emulsion having a mean grain size of about 0.20 μm or smaller.

A color developing solution which can be used for development processing the materials of the invention preferably is an alkaline aqueous solution containing an aromatic primary amine color developing agent. The color developing agent used typically includes 4-amino-N,N-diethylaniline, 3-methyl-4-N,N-diethylaniline, 4-amino-N-ethyl-β-hydroxydiethylaniline, 3-methyl-4-amino-N-ethyl-N-β-hydroxyethylaniline, 3-methyl-4-amino-N-ethyl-N-β-methanesulfonamidoethylaniline, 4-amino-3-methyl-N-ethyl-N-β-methoxyethylaniline, etc.

The photographic emulsion layers after color development are usually subjected to bleaching. Bleaching may be effected simultaneously with fixation, or these two steps may be carried out separately. For speeding up of processing, bleaching may be followed by bleach-fixation (blix). Bleaching agents to be used in bleaching or blix include compounds of polyvalent metals, e.g., iron (III), cobalt (III), chromium (VI), copper (II), etc., peracids, quinones, nitroso compounds, and the like. Examples of these bleaching agents are ferricyanides; bichromates; organic complex salts of iron (III) or cobalt (III), such as complex salts with aminopolycarboxylic acids, e.g., ethylenediaminetetraacetic acid, diethylenetriaminepentaacetic acid, nitrilotriacetic acid, 1,3-diamino-2-propanoltetraacetic acid, etc., or organic acids, e.g., citric acid, tartaric acid, malic acid, etc.; persulfates; manganates; nitrosophenol; and so on. Of these, potassium ferricyanide, sodium (ethylenediaminetetraacetato) iron (III), and ammonium (ethylenediaminetetraacetato) iron (III) are particularly useful. The (ethylenediaminetetraacetato) iron (III) salts are useful in both separate bleaching bath and a bleach-fix monobath.

The photographic emulsion layers after color development or bleach-fix may be subjected to washing. Color development can be carried out at a temperature selected from about 18° C. to 55° C., and preferably about 30° C. or higher, and more preferably about 35° C. or higher. The development time is selected from about 1 to 3.5 minutes, and the shorter time is preferred. When development is performed in a continuous process, a replenisher is preferably used at a rate of from about 160 to 330 ml/m$^2$, and preferably about 100 ml/m$^2$ or less. The benzyl alcohol content in the developing solution is preferably not more than about 5 ml/l.

Bleach-fixing can be performed at a temperature selected from about 18° C. to 50° C., and preferably at about 30° C. or higher. Processing at about 35° C. or higher temperatures not only shortens the time required to about 1 minute or less but also reduces the requisite amount of replenisher. The time required for washing after the color development or bleach-fix is usually less than about 3 minutes. Washing can be substantially omitted by using a stabilizing bath.

Washing is generally carried out by using two or more washing vessels arranged countercurrently, to save water. Stabilization in place of the washing step can be typically performed by multi-stage countercurrent stabilization as described in Japanese Patent Application (OPI) No. 8543/82.

The developed dyes are discolored not only by light, heat or humidity, but also by mold during preservation. In particular, cyan dye images undergo great deterioration due to mold so that use of antifungal agents is desirable. Examples of usable antifungal agents include 2-thiazolylbenzimidazoles as disclosed in Japanese Patent Application (OPI) No. 157244. The antifungal agents may be incorporated in the light-sensitive materials or externally supplied at any stage of development processing, being added to any processing solution.

As described previously, the present invention provides a color photographic material which can be processed in a partially exhausted bleach solution or a solution having weak bleaching capacity. Such features are advantageous in that substantially no reduction in color density occurs by failing to supply a replenisher or by decreasing an amount of the replenisher in a running processing in the laboratory.

The present invention will now be illustrated in greater detail by way of the following examples, but the present invention is not to be construed as being limited thereto. In these examples, all parts, percents and ratios are given by weight unless otherwise indicated.

EXAMPLE 1

A mixture of 5.1 g of Coupler (I-2), 4.9 g of Coupler (II-1), 10 g of dibutyl phthalate, and 20 ml of ethyl acetate was heated to 50° C. to form a solution. The solution was dispersed in 80 g of a gelatin aqueous solution containing 8 ml of a 1% aqueous solution of sodium dodecylbenzenesulfonate.

The resulting dispersion was mixed with 145 g of a red-sensitive silver chlorobromide emulsion (Br content: 50 mol%; Ag content: 7 g; cubic core/shell type grains having an average grain size of 0.45 μm; deviation coefficient: 10%), and sodium dodecylbenzenesulfonate was added thereto as a coating aid. The resulting coating composition was coated on a support laminated with polyethylene on both sides thereof. The total coating amount of the couplers was 0.58 mmol/m$^2$. A gelatin protective layer was coated thereon to a gelatin coverage of 1 g/m$^2$. The resulting light-sensitive material was designated as Sample A.

Samples B to Q were prepared in the same manner as for Sample A, except for changing the kind and ratio of couplers as shown in Table 1 below.

TABLE 1

| Sample No. | Coupler I | Coupler II | Ratio* | Remark |
|---|---|---|---|---|
| A | I-1 | II-1 | 1 | Invention |
| B | I-2 | II-1 | 2 | " |
| C | I-2 | II-3 | 2 | " |
| D | I-2 | II-6 | 2 | " |
| E | I-2 | II-8 | 2 | " |
| F | I-2 | II-12 | 2 | " |
| G | I-7 | II-1 | 1 | " |
| H | I-7 | II-3 | 2 | " |
| I | I-23 | II-3 | 2 | " |
| J | I-24 | II-3 | 2 | " |
| K | I-31 | II-3 | 2 | " |
| L | II-21 | | — | " |
| M | A-1** | — | — | Comparison |
| N | I-2 | — | — | " |
| O | I-7 | — | — | " |
| P | — | II-3 | — | " |
| Q | III-1 | II-3 | 1 | " |

Note:
*Coupler I/Coupler II molar ratio
**Coupler A-1:

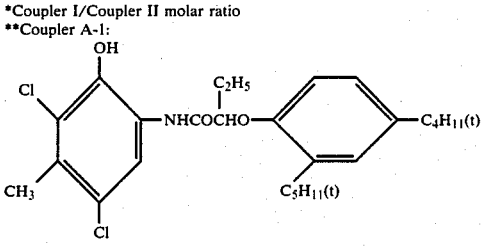

Each of Samples A to Q was exposed to light through a continuous wedge for sensitometry and then subjected to development processing according to the following procedure.

| Color Development Processing (33° C.) | Time |
|---|---|
| 1. Color Development | 3'30" |
| 2. Bleach-Fix | 1'30" |
| 3. Washing | 2'30" |

The processing solutions used in the respective processing steps had the following formulations.

Color Developer Formulation

| | |
|---|---|
| Benzyl alcohol | 15.0 ml |
| Diethylene glycol | 8.0 ml |
| Ethylenediaminetetraacetic acid | 5.0 g |
| Sodium sulfite | 2.0 g |
| Anhydrous potassium carbonate | 30 g |
| Hydroxylamine sulfate | 3.0 g |
| Potassium bromide | 0.6 g |
| 4-Amino-N—ethyl-N—(β-methanesulfonamidoethyl)-m-toluidine sesquisulfate monohydrate | 5.0 g |
| Water to make | 1 |

Bleach-Fix Bath Formulation

| | |
|---|---|
| Ethylenediaminetetraacetic acid | 4.0 g |
| (Ethylenediaminetetraacetato)ferrite | 40 g |
| Sodium sulfite | 5.0 g |
| Sodium thiosulfate (70%) | 150 ml |
| Water to make | 1 l |

The fastness of the cyan images produced was evaluated as follows. The samples were kept in the dark at 100° C. for 6 days (Condition I) or at 60° C. and 70% RH for 6 weeks (Condition II) or exposed to light in a xenon tester (100000 luxes) for 6 days (Condition III), and the percent of reduction in density in an area having an initial density of 1.0 was determined.

Further, yellowing on the white background was evaluated by determining the increase of blue density in an unexposed area (white background) of the samples treated under Condition III. The results obtained are shown in Table 2.

TABLE 2

| Sample No. | Fastness of Cyan Image (Reduction in Density) Condition I (%) | Condition II (%) | Condition III (%) | Yellowing |
|---|---|---|---|---|
| A | 9 | 10 | 18 | +0.08 |
| B | 8 | 7 | 16 | +0.10 |
| C | 7 | 7 | 14 | +0.09 |
| D | 9 | 8 | 15 | +0.07 |
| E | 8 | 7 | 13 | +0.10 |
| F | 6 | 6 | 14 | +0.11 |
| G | 9 | 10 | 19 | +0.08 |
| H | 7 | 7 | 14 | +0.09 |
| I | 8 | 7 | 13 | +0.07 |
| J | 7 | 6 | 12 | +0.09 |
| K | 9 | 8 | 15 | +0.08 |
| L | 6 | 6 | 12 | +0.06 |
| M | 56 | 53 | 18 | +0.11 |
| N | 8 | 9 | 11 | +0.31 |
| O | 8 | 7 | 12 | +0.28 |
| P | 7 | 8 | 35 | +0.09 |
| Q | 3 | 34 | 28 | +0.11 |

As can be seen by comparing Table 2 with Table 1, Samples C and H according to the present invention contained a combination of a coupler causing serious yellowing (as in Samples N and O) and a coupler having inferior light-fastness (as in Sample P). Nevertheless, these samples exhibited a marked improvement in yellowing while minimizing loss of light-fastness.

EXAMPLE 2

Multi-layer multicolor photographic materials were prepared by coating the 1st (undermost) to 7th (uppermost) layers on a polyethylene-laminated (both sides) paper support as described in Tables 3 and 4. The resulting samples were designated Samples A' to S'.

The coating composition for the 1st layer was prepared according to the method described below illustrating the preparation of Sample A'.

In a mixed solvent of 10 ml of ethyl acetate and 4 ml of Solvent (c) were dissolved 10 g of Yellow Coupler (a-1) and 2.3 g of Dye Image Stabilizer (b), and the resulting solution was dispersed in 90 ml of a 10% gelatin aqueous solution containing 5 ml of a 10% aqueous solution of sodium dodecylbenzenesulfonate. Separately, 90 g of a blue-sensitive emulsion was prepared by adding a blue spectral sensitizer shown below to a silver chlorobromide emulsion (silver bromide: 2 mol%; Ag content: 70 g/Kg) in an amount of $4.0\times10^{-4}$ mol per mol of silver chlorobromide. The above-prepared coupler dispersion and the silver halide emulsion were mixed, and the gelatin concentration of the emulsion thus prepared was adjusted so as to have the composition shown in Table 3.

Coating compositions for the 2nd to 7th layers were also prepared in the same manner with the substitutions shown below. In the total layers, 100 mg/m$^2$ of a sodium salt of 1-hydroxy-3,5-dichloro-s-triazine was used as a gelatin hardener.

The spectral sensitizers used for the respective emulsion layer and the amount used are shown below. Blue-Sensitive Emulsion Layer:

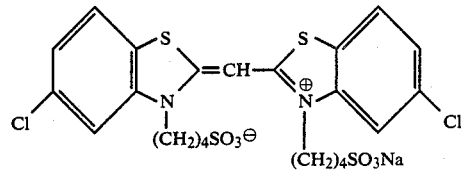

($4.0\times10^{-4}$ mol/mol of silver halide)

Green-Sensitive Emulsion Layer

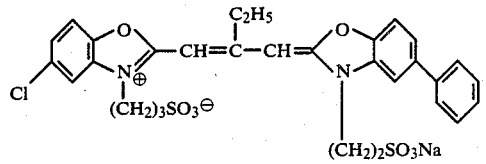

($3.0\times10^{-4}$ mol/mol of silver halide)

Red-Sensitive Emulsion Layer

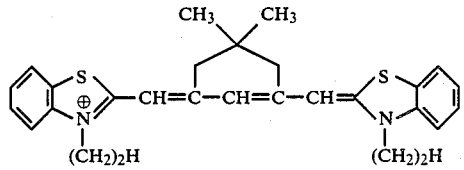

$I^{\ominus}$ ($1.0\times10^{-4}$ mol/mol of silver halide)

The anti-irradiation dyes used in the emulsion layers are shown below:

Green-Sensitive Emulsion Layer
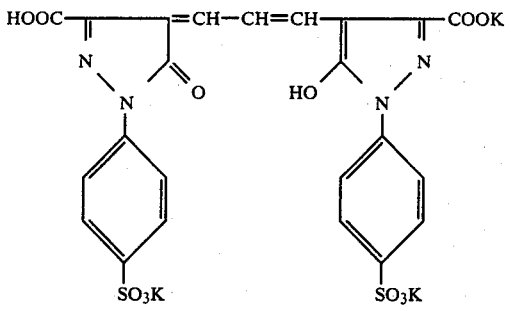
Red-Sensitive Emulsion Layer
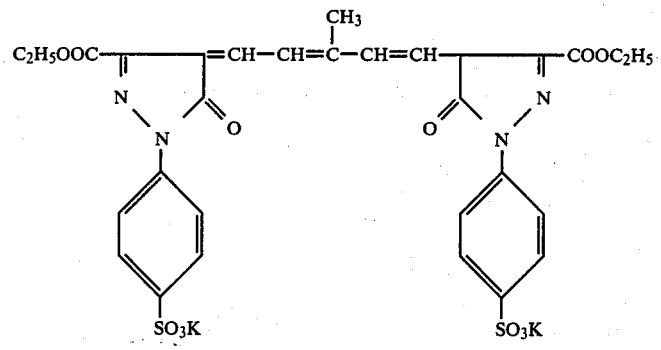
Prior to coating, each of the coating compositions for the 1st to 7th layers are adjusted to have a balance between surface tension and viscosity.
The chemical formulae of the compounds used in the sample preparation are shown below.
(a) Yellow Coupler
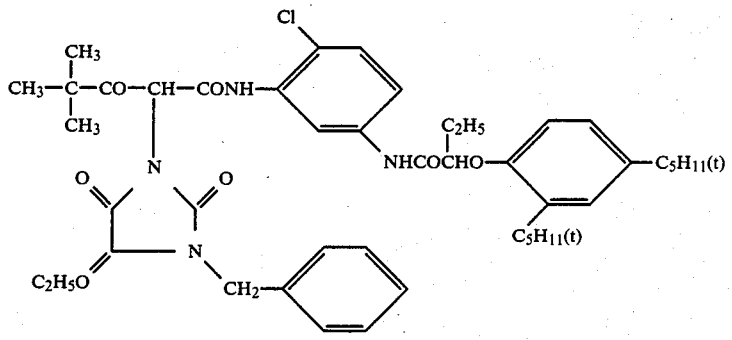
(a-1)
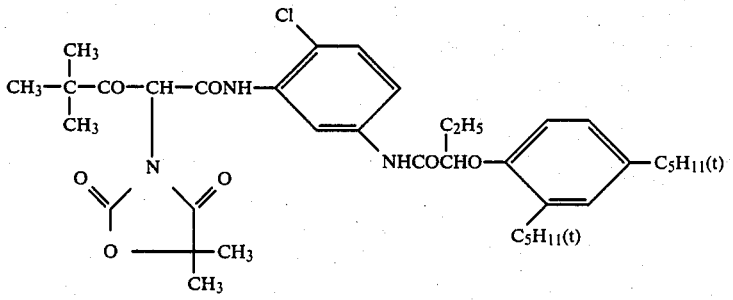
(a-2)

-continued
(a-3)
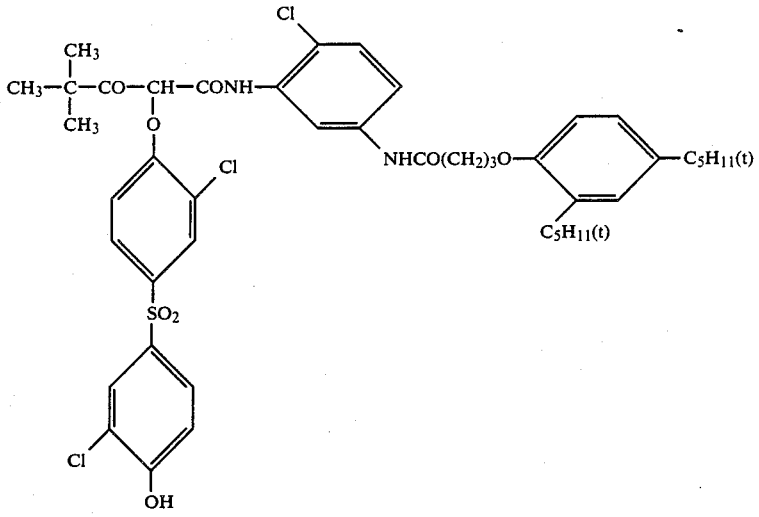
(a-4)
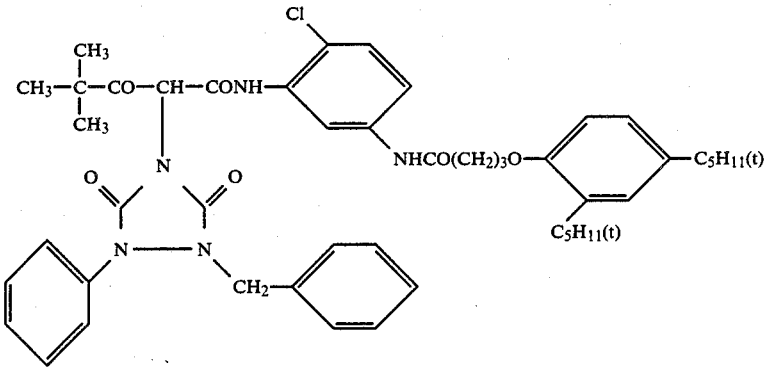
(b) Dye Image Stabilizer
(d) Color Mixing Inhibitor
(b-1)
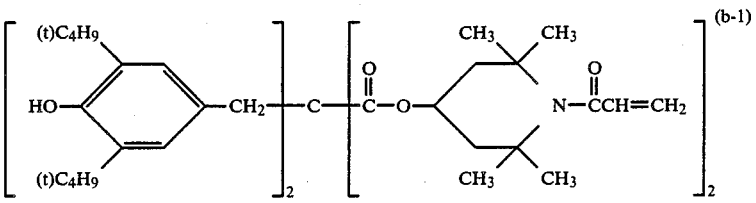
(b-2)
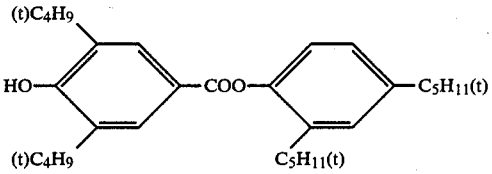
(c) Solvent
(iso $C_9H_{19}O)_3P{=}O$
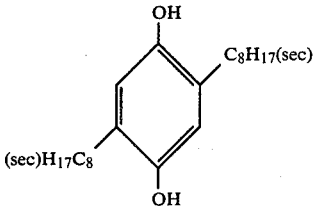
(e) Magenta Coupler (e-1)
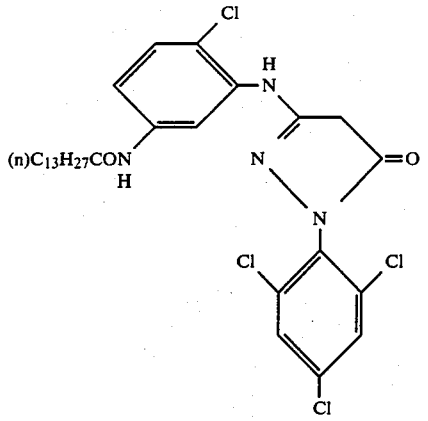
(e-2)
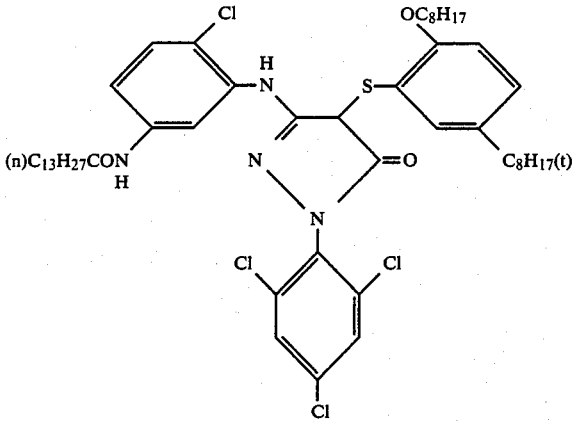
(e-3)
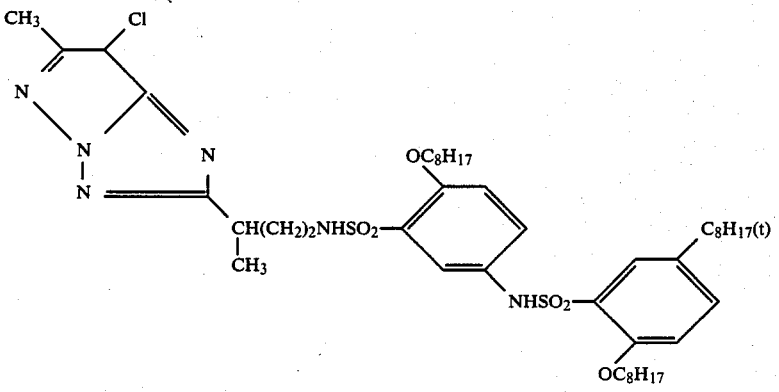
(f) Dye Image Stabilizer
(f-1)
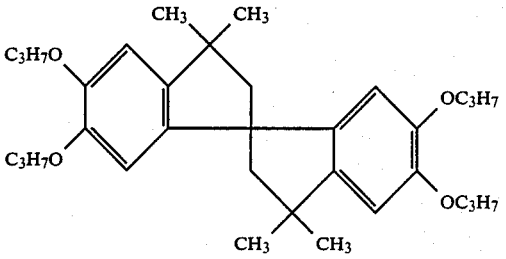
-continued
(f-2)
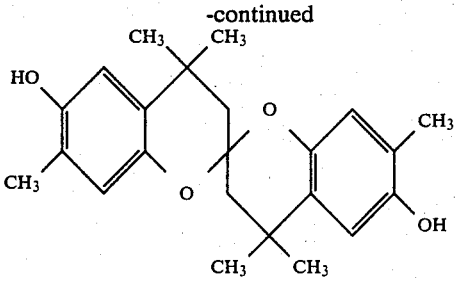

-continued
(f-3)
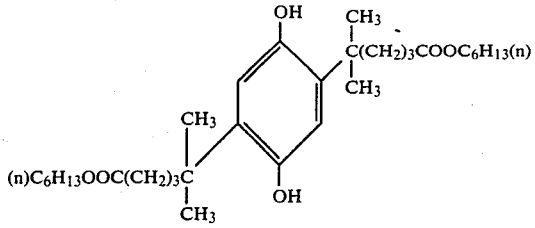
(f-4)
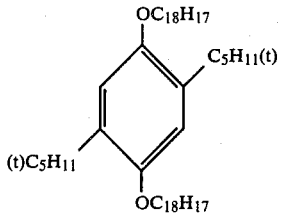
(f-5)
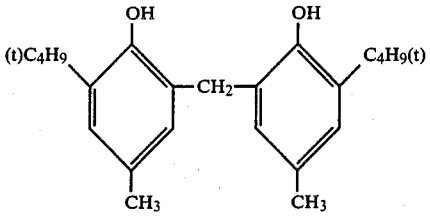
(g) Solvent
2:1 (by wt.) mixture of
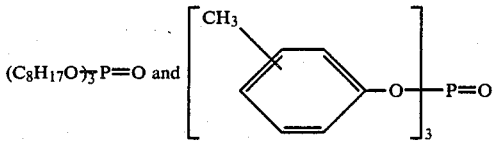
(h) Ultrabiolet Absorbent
A 1:5:3 (by mol) mixture of
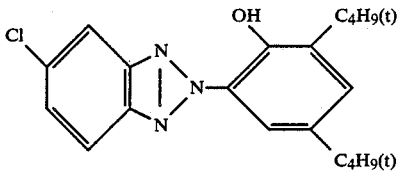
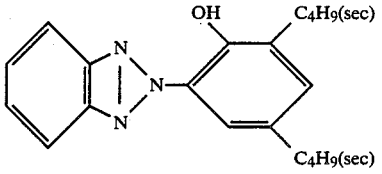
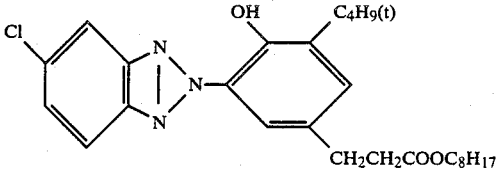
(i) Color Mixing Inhibitor
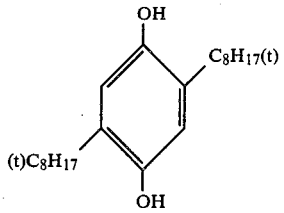
(j) Solvent
$(iso\ C_9H_{19}O)_3P{=}O$
(l) Dye Image Stabilizer
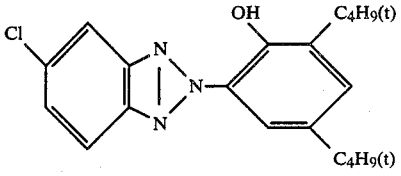
(l-1)
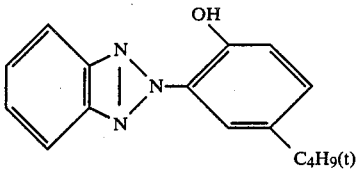
(l-2)
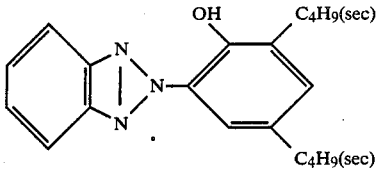
(l-3)
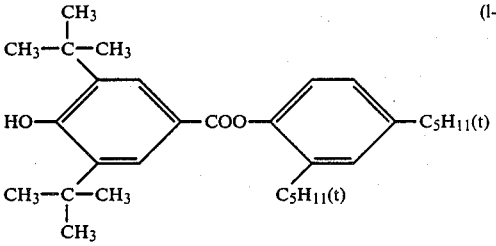
(l-4)
(m) Solvent
$(iso\text{-}C_9H_{19}O)_3P{=}O$ (n) Auxiliary Developing Agent

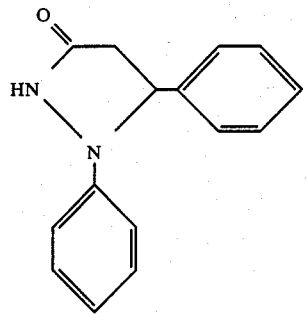

TABLE 3

| Layer | Main Component | Coverage |
|---|---|---|
| 7th Layer (Protective layer) | Gelatin | 1.33 g/m$^2$ |
| | Acryl-modified copolymer of polyvinyl alcohol (degree of modification: 17%) | 1.17 g/m$^2$ |
| 6th Layer (Ultraviolet absorbing layer) | Gelatin | 0.54 g/m$^2$ |
| | Ultraviolet absorbent (h) | $5.10 \times 10^{-4}$ mol/m$^2$ |
| | Solvent | 0.08 g/m$^2$ |
| 5th Layer (Red-sensitive layer) | Silver chlorobromide emulsion (cubic grains having an average grain size of 0.45 m; deviation coefficient: 11%; silver bromide: 1 mol %) | 0.22 g of Ag/m$^2$ |
| | Silver bromide emulsion (grain size: 0.1 μm) | 0.005 g of Ag/m$^2$ |
| | Gelatin | 0.90 g/m$^2$ |
| | Cyan coupler (k) (shown in Table 4) | $7.05 \times 10^{-4}$ mol/m$^2$ |
| | Dye image stabilizer (l) (shown in Table 4) | $5.20 \times 10^{-4}$ mol/m$^2$ |
| | Solvent (m) | 0.22 g/m$^2$ |
| 4th Layer (Ultraviolet absorbing layer) | Gelatin | 1.60 g/m$^2$ |
| | Ultraviolet absorbent (h) | $1.70 \times 10^{-4}$ mol/m$^2$ |
| | Color mixing inhibitor (i) | $1.60 \times 10^{-4}$ mol/m$^2$ |
| | Solvent (j) | 0.27 g/m$^2$ |
| 3rd Layer (Green-sensitive layer) | Silver chlorobromide emulsion (cubic grains having an average grain size of 0.45 μm; deviation coefficient: 11%; silver bromide: 1 mol %) | 0.15 g of Ag/m$^2$ |
| | Silver bromide emulsion (grain size: 0.1 μm) | 0.007 g of Ag/m$^2$ |
| | Gelatin | 1.56 g/m$^2$ |
| | Magenta coupler (e) (shown in Table 4) | $3.38 \times 10^{-4}$ mol/m$^2$ |
| | Dye image stabilizer (f) (shown in Table 4) | $1.69 \times 10^{-4}$ mol/m$^2$ |
| | Solvent (g) | 0.57 g/m$^2$ |
| 2nd Layer (Color-mixing inhibiting layer) | Gelatin | 0.70 g/m$^2$ |
| | Color mixing inhibitor (d) | $2.33 \times 10^{-4}$ mol/m$^2$ |
| 1st Layer (Blue-sensitive layer) | Silver chlorobromide emulsion (cubic grains having an average grain size of 0.85 μm; deviation coefficient: 12%; silver bromide: 2 mol %) | 0.35 g of Ag/m$^2$ |
| | Gelatin | 1.35 g/m$^2$ |
| | Yellow coupler (a) (shown in Table 4) | $6.91 \times 10^{-4}$ mol/m$^2$ |
| | Dye image stabilizer (b) (shown in Table 4) | 1.13 g/m$^2$ |
| | Solvent (c) | 0.02 g/m$^2$ |
| Support | Paper laminated with polyethylene on both sides thereof. The polyethylene on the side coated contained a white pigment ($TiO_2$) and a bluing dye (ultramarine, etc.). | |

TABLE 4

| Sample No. | Cyan Coupler (k) Coupler I | Cyan Coupler (k) Coupler II | Cyan Coupler (k) Ratio* | Yellow Coupler (a) | Magenta Coupler (b) | Dry Image Stabilizer (b) | Dye Image Stabilizer (f) | Dye Image Stabilizer (l) | Remark |
|---|---|---|---|---|---|---|---|---|---|
| A' | I-2 | II-3 | 2:1 | (a)-1 | (e)-1 | (b)-1 | (f-1)/(f-2)/(f-3) (1:1:1 by mol) | (l-1)/(l-2)/(l-3) (1:3:3 by mol) | Invention |
| B' | I-2 | II-3 | 2:1 | " | (e)-2 | " | (f-1)/(f-2)/(f-3) (1:1:1 by mol) | (l-1)/(l-2)/(l-3) (1:3:3 by mol) | " |
| C' | I-2 | II-6 | 2:1 | (a)-1** | " | " | (f-1)/(f-2)/(f-3) (1:1:1 by mol) | (l-1)/(l-2)/(l-3) (1:3:3 by mol) | " |
| D' | I-2 | II-8 | 1:1 | (a)-2 | " | " | (f-1)/(f-2)/(f-3) (1:1:1 by mol) | (l-1)/(l-2)/(l-3) (1:3:3 by mol) | " |
| E' | I-22 | II-6 | 2:1 | " | " | " | (f-1)/(f-2)/(f-3) (1:1:1 by mol) | (l-1)/(l-2)/(l-3) (1:3:3 by mol) | " |
| F' | I-22 | II-6 | 2:1 | " | " | " | (f-1) | (l-1)/(l-2)/(l-3 (1:3:3 by mol) | " |
| G' | I-22 | II-8 | 2:1 | (a)-4 | (e)-4 | (b)-2 | (f-4)/(f-5) (1:1 by mol) | (l-4) | " |
| H' | I-7 | II-2 | 2:1 | (a)-3 | (e)-3 | (b)-1 | (f-1) | " | " |
| I' | I-7 | II-4 | 2:1 | (a)-2 | (e)-2 | " | (f-1)/(f-2)/(f-3) | " | " |

TABLE 4-continued

| Sample No. | Cyan Coupler (k) Coupler I | Coupler II | Ratio* | Yellow Coupler (a) | Magenta Coupler (b) | Dry Image Stabilizer (b) | Dye Image Stabilizer (f) | Dye Image Stabilizer (l) | Remark |
|---|---|---|---|---|---|---|---|---|---|
| J' | I-24 | II-17 | 2:1 | (a)-2** | (e)-3 | " | (1:1:1 by mol) (f-1) | " | " |
| K' | I-24 | II-8 | 1:1 | (a)-4 | " | (b)-2 | (f-4)/(f-5) | " | " |
| L' | I-31 | II-8 | 2:1 | " | (e)-4 | " | (1:1 by mol) (f-4)/(f-5) | " | " |
| M' | III-1 | — | — | (a)-1 | (e)-1 | (b)-1 | (1:1 by mol) (f-1)/(f-2)/(f-3) | (l-1)/(l-2)/(l-3) | Comparison |
| N' | III-2 | — | — | " | " | " | (1:1:1 by mol) (f-1)/(f-2)/(f-3) | (1:3:3 by mol) (l-1)/(l-2)/(l-3) | " |
| O' | I-7 | — | — | " | (e)-2 | " | (1:1:1 by mol) (f-1)/(f-2)/(f-3) | (1:3:3 by mol) (l-1)/(l-2)/(l-3) | " |
| P' | — | II-3 | — | (a)-2 | " | " | (1:1:1 by mol) (f-1)/(f-2)/(f-3) | (1:3:3 by mol) (l-1)/(l-2)/(l-3) | " |
| Q' | III-1 | II-3 | 2:1 | " | " | " | (1:1:1 by mol) (f-1)/(f-2)/(f-3) | (1:3:3 by mol) (l-1)/(l-2)/(l-3) | " |
| R' | III-2 | II-3 | 2:1 | (a)-3 | (e)-3 | " | (1:1:1 by mol) (f-1) | (1:3:3 by mol) (l-4) | " |
| S' | III-3 | I-7 | 2:1 | (a)-2 | (e)-2 | " | (f-1)/(f-2)/(f-3) (1:1:1 by mol) | (l-1/(l-20/(l-3) (1:3:3 by mol) | " |

Note:
*Molar ratio of Coupler I/Coupler II
**10 mol % of (n) to added to the yellow coupler.

Each of Samples A' to S' was exposed to light through a continuous wedge for sensitometry and subjected to development processing according to the following procedure.

| Processing Step | Temperature | Time |
|---|---|---|
| Color Development | 33° C. | 3 min. 30 sec. |
| Bleach-Fix | 33° C. | 1 min. 30 sec. |
| Washing | 24–34° C. | 3 min. |
| Drying | 80° C. | 1 min. |

The processing solution used in each processing step had the following formulation.

Color Developer (A)

| | |
|---|---|
| Water | 800 ml |
| Diethylenetriaminepentaacetic acid | 3.0 g |
| Benzyl alcohol | 15 ml |
| Diethylene glycol | 10 ml |
| Sodium sulfite | 2.0 g |
| Potassium bromide | 0.5 g |
| Potassium carbonate | 30.0 g |
| N—Ethyl-N—(β-methanesulfonamidoethyl)-3-methyl-4-aminoaniline sulfate | 5.0 g |
| Hydroxylamine sulfate | 4.0 g |
| Fluorescent brightening agent (4,4'-stilbene type) | 1.0 g |
| Water to make | 1000 ml |
| (pH at 25° C.: | 10.10) |

Bleach-Fix Bath (A-1)

| | |
|---|---|
| Water | 400 ml |
| Ammonium thiosulfate (70% solution) | 150 ml |
| Sodium sulfite | 18 g |
| Ammonium (ethylenediaminetetra-acetato) iron (III) | 55 g |
| Disodium ethylenediaminetetraacetate | 5 g |

Bleach-Fix Bath (A-2)

The same formulation as Bleach-Fix Bath (A-2) plus 30 ml of Color Developer (A).

Bleach-Fix Bath (A-3)

After imagewise exposure to light, the above light-sensitive material was subjected to the running processing using a Fuji Color Paper Processing Apparatus PP 600 (produced by Fuji Photo Film Co., Ltd.) according to the following processing steps, until the processing solutions have been replenished with the solutions in a volume twice the volume of a color developing tank whereby the processing solutions in a fatigued state was obtained.

| Processing Step | Temperature | Time | Amount of Replenisher* | Volume of Processing Tank |
|---|---|---|---|---|
| Color Development | 38° C. | 1 min. 40 sec. | 290 ml | 17 l |
| Bleach-Fix | 33° C. | 1 min. | 150 ml | 9 l |
| Rinsing (1) | 30–34° C. | 20 sec. | — | 4 l |
| Rinsing (2) | 30–34° C. | 20 sec. | — | 4 l |
| Rinsing (3) | 30–34° C. | 20 sec. | 364 ml | 4 l |
| Drying | 70–80° C. | 50 sec. | | |

*The amount per $m^2$ of the light-sensitive material. Rinsing water was passed through three rinsing tanks countercurrently from rinsing tank (3) to rinsing tank (1).

The processing solution used in each step had the following formulation.

| | Tank Solution | Replenisher |
|---|---|---|
| Color Developer: | | |
| Water | 800 ml | 800 ml |
| Diethylenetriaminepentaacetic acid | 1.0 g | 1.0 g |

-continued

| | Tank Solution | Replenisher |
|---|---|---|
| Nitrilotriacetate | 2.0 g | 2.0 g |
| 1-Hydroxyethylidene-1,1-diphosphonic acid | 2.0 g | 2.0 g |
| Benzyl alcohol | 16 ml | 22 ml |
| Diethylene glycol | 10 ml | 10 ml |
| Sodium sulfite | 0.5 g | — |
| Potassium carbonate | 30 g | 30 g |
| N—Ethyl-N—(β-methanesulfonamidoethyl)-3-methyl-4-aminoaniline sulfate | 5.5 g | 7.5 g |
| Hydroxylamine sulfate | 2.0 g | 2.5 g |
| Fluorescent brightening agent ("WHITEX 4B" produced by Sumitomo Chemical Co., Ltd.) | 1.5 g | 2.0 g |
| Water to make | 1000 ml | 1000 ml |
| pH (at 25° C.) | 10.20 | 10.60 |
| Bleach-Fix Bath (A-3): | | |
| Water | 400 ml | 400 ml |
| Ammonium thiosulfate (70%) | 200 ml | 300 ml |
| Sodium sulfite | 20 g | 40 g |
| Ammonium ethylenediaminetetraacetato) iron (III) | 60 g | 120 g |
| Disodium ethylenediaminetetraacetate | 5 g | 10 g |
| Water to make | 1000 ml | 1000 ml |
| pH (at 25° C.) | 6.70 | 6.30 |

Rinsing Solution

Tap water was passed through a mixed-bed type column packed with H-type strongly acidic cation exchange resin (Amberlite R-120B produced by Rohm & Haas) and OH-type strongly basic anion exchange resin (Amberlite IRA-400 produced by Rohm & Haas) to reduce calcium and magnesium contents to 3 mg/l or less, and sodium dichloroisocyanurate and sodium sulfate were added thereto in amounts of 20 mg/l and 150 mg/l, respectively. The resulting solution had a pH value in the range of from 6.5 to 7.5, and was used as a tank rinsing solution and as a replenisher.

The amount of the bleach-fix bath solution conveyed into the rinsing step during the processing was about 40 ml per $m^2$ of the processed light-sensitive material.

Each of the thus-developed samples was evaluated for maximum density ($D_{R\ max}$) by means of an automatic densitometer. The results obtained are shown in Table 5 below.

TABLE 5

| Sample No. | $D_{R\ max}$ (A-1) | (A-2) | (A-3) | Remark |
|---|---|---|---|---|
| A' | 2.90 | 2.82 | 2.80 | Invention |
| B' | 2.92 | 2.83 | 2.82 | " |
| C' | 2.95 | 2.85 | 2.83 | " |
| D' | 2.89 | 2.86 | 2.83 | " |
| E' | 2.88 | 2.84 | 2.83 | " |
| F' | 2.86 | 2.82 | 2.81 | " |
| G' | 2.89 | 2.83 | 2.80 | " |
| H' | 2.88 | 2.82 | 2.80 | " |
| I' | 2.87 | 2.83 | 2.82 | " |
| J' | 2.93 | 2.86 | 2.84 | " |
| K' | 2.95 | 2.90 | 2.87 | " |
| L' | 3.01 | 2.95 | 2.90 | " |
| M' | 2.89 | 2.51 | 2.47 | Comparison |
| N' | 2.85 | 2.53 | 2.50 | " |
| O' | 2.78 | 2.60 | 2.57 | " |
| P' | 2.88 | 2.64 | 2.62 | " |
| Q' | 2.88 | 2.58 | 2.54 | " |
| R' | 2.86 | 2.60 | 2.55 | " |
| S' | 2.80 | 2.57 | 2.52 | " |

It can be seen from these results that the light-sensitive materials containing the coupler combinations according to the present invention underwent smaller reduction in cyan density when processed with a fatigued bleach-fix bath than the comparative samples.

EXAMPLE 3

Each of Samples B', E', I', J', and K' as prepared in Example 2 was exposed to light in the same manner as in Example 2 and then subjected to development processing according to the following procedure.

| Processing Step | Temperature | Time |
|---|---|---|
| Color Development | 35° C. | 45 sec. |
| Bleach-Fix | 35° C. | 45 sec. |
| Rinsing (1) | 30° C. | 20 sec. |
| Rinsing (2) | 30° C. | 20 sec. |
| Rinsing (3) | 30° C. | 20 sec. |
| Rinsing (4) | 30° C. | 20 sec. |
| Drying | 70° C. | 1 min. |

The processing solution used in each step had the following formulation.

Color Developer (B)

| | |
|---|---|
| Triethanolamine | 8.12 g |
| 4,4'-Diaminostilbene type fluorescent brightening agent ("WHITEX 4" produced by Sumitomo Chemical Co., Ltd.) | 2.81 g |
| N,N—Diethylhydroxylamine (85%) | 4.93 g |
| Sodium chloride | 1.36 g |
| Sodium sulfite | 0.13 g |
| N—Ethyl-N—(β-methanesulfonamidoethyl)-3-methyl-4-aminoaniline sulfate | 4.96 g |
| Potassium carbonate | 18.4 g |
| Potassium hydrogencarbonate | 4.85 g |
| Disodium ethylenediaminetetraacetate dihydrate | 2.2 g |
| Water to make | 1000 ml |
| (pH = 10.05, adjusted with KOH) | |

Bleach-Fix Bath (B)

| | |
|---|---|
| Ammonium (ethylenediaminetetraacetato) iron (III) dihydrate | 54.1 g |
| Disodium ethylenediaminetetraacetate dihydrate | 3.41 g |
| Ammonium thiosulfate (70%) | 103 ml |
| Sodium sulfite | 16.71 g |
| Glacial acetic acid | 8.55 g |
| Water to make | 1000 ml |
| | (pH = 5.7) |

Rinsing Solution

| | |
|---|---|
| Benzotriazole | 1.0 g |
| Ethylenediaminetetramethylene-phosphonic acid | 0.5 g |
| Potassium hydroxide | for pH adjustment |
| Water to make | 1000 ml |
| | (pH = 7.5) |

The above-described rinsing solution was used in all of rinsing steps (1) to (4).

In order to evaluate the fastness of the dye images obtained, each of the thus-developed samples kept in the dark at 100° C. for 12 days (Condition I) or exposed to light in a xenon tester (100000 luxes) for 12 days (Condition II). The percent reduction in cyan, magenta or yellow density in an area having an initial density of 1.0 was determined. The results obtained are shown in Table 6 below.

TABLE 6

| Sample No. | Density Reduction (%) Condition I B | G | R | Condition II B | G | R | Remark |
|---|---|---|---|---|---|---|---|
| B' | 4 | 5 | 6 | 10 | 13 | 7 | Invention |
| E' | 3 | 6 | 7 | 8 | 9 | 6 | " |
| I' | 4 | 6 | 6 | 9 | 12 | 6 | " |
| J' | 4 | 7 | 5 | 8 | 8 | 7 | " |
| K' | 5 | 5 | 6 | 8 | 10 | 7 | " |

As is apparent from Table 6, the light-sensitive materials according to the present invention have excellent fastness to light and heat, and retain a good balance of the three colors.

As described above, the combinations of the cyan couplers according to the present invention provide dye images excellent in fastness to light, heat, and particularly heat and humidity. Further, such coupler combinations markedly improve yellowing of unexposed areas (white background) due to light exposure. Furthermore, the color photographic materials of the present invention exhibit excellent color developability, substantially free from density reduction even when processed with a bleaching solution having a weak oxidizing capacity or a fatigued bleaching solution.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a support having thereon at least one light-sensitive layer, said material containing at least one cyan dye forming coupler represented by the following formula (I) and at least one cyan dye forming coupler represented by the following formula (II):

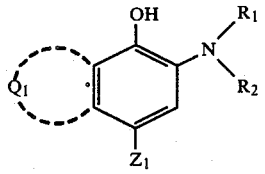

(I)

wherein $Q_1$ represents an atomic group necessary for forming a heterocyclic ring having at least 5-members and containing at least one nitrogen atom; $Z_1$ represents a hydrogen atom or a group releasable upon coupling with an oxidation product of a color developing agent; $R_1$ represents a group bonded to the nitrogen atom by an acyl group or a sulfonyl group; and $R_2$ represents a hydrogen atom or an aliphatic group having from 1 to 8 carbon atoms, provided that at least two coupler moieties represented by formula (I) may be linked by any of $R_1$, $R_2$, $Z_1$ and $Q_1$ to form a dimer or a higher polymer which may contain at least one coupler moiety represented by formula (II); and

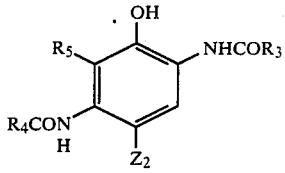

(II)

wherein $Z_2$ has the same definition as $Z_1$ in formula (I); $R_3$ and $R_4$, which may be the same or different, each represents an aliphatic group, an aromatic group, a heterocyclic group, an aromatic amino group, a heterocyclic amino group or an aliphatic oxy group; and $R_5$ represents a hydrogen atom, a halogen atom, an acylamino group, an aliphatic group or an aromatic group; provided that at least two coupler moieties represented by formula (II) may be linked by any of $Z_2$, $R_3$, $R_4$ or $R_5$ to form a dimer or a higher polymer which may contain at least one coupler moiety represented by formula (I).

2. The silver halide color photographic material as claimed in claim 1, wherein $Q_1$ in addition to said nitrogen atom comprises a substituted or unsubstituted member selected from the group consisting of a divalent amino group, an ether group, a thioether group, a straight or branched chain alkylene group, a vinylene group, an imino group, a sulfonyl group, a carbonyl group, an arylene group, a divalent heterocyclic group, a group represented by formula

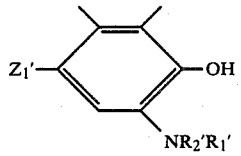

wherein $Z_1'$ has the same definition as $Z_1$, $R_1'$ has the same definition as $R_1$, and $R_2'$ has the same definition as $R_2$, and a combination of these divalent groups; the coupling releasable group represented by each of $Z_1$ and $Z_2$ is selected from the group consisting of a halogen atom, an alkoxy group, an aryloxy group, and acyloxy group, a sulfonyloxy group, an amido group, an alkoxycarbonyloxy group, an aryloxycarbonyloxy group, an aliphatic thio group, an aromatic thio group, an imido group, and an aromatic azo group; $R_1$ represents $—CO—R_7$ or $—SO_2—R_7$; $R_7$, $R_3$, $R_4$, which may be the same or different, each represents a group selected from a substituted or unsubstituted aliphatic group having from 1 to 32 carbon atoms, a substituted or unsubstituted aryl group, a substituted or unsubstituted heterocyclic group, a substituted or unsubstituted aromatic amino group, a substituted or unsubstituted heterocyclic amino group and a substituted or unsubstituted aliphatic oxy group; $R_2$ represents a hydrogen atom, or a substituted or unsubstituted aliphatic group having from 1 to 8 carbon atoms; $R_5$ represents a hydrogen atom, a halogen atom, and an acylamino group, an alkoxy group, an aliphatic or an aromatic group; and the substituent for each said substituted group is selected from the group consisting of an alkyl group, an aryl group, a heterocyclic group, an alkoxy group, an aryloxy group, an alkenyloxy group, an acyl group, an ester group, an amido group, a sulfamido group, an imido group, a ureido group, an aliphatic sulfonyl group, an aromatic sulfonyl group, an aliphatic thio group, an aromatic thio group, a hydroxyl group, a cyano group, a carboxyl group, a nitro group, a sulfo group and a halogen atom.

3. The silver halide color photographic material as claimed in claim 2, wherein $Q_1$ represents —$NR_6$—CO—$Q_1'$, wherein $Q_1'$ represents a substituted or unsubstituted member selected from group consisting of a divalent amino group, an ether group, a thioether group, an alkylene group, a vinylene group, an imino group, a sulfonyl group, a carbonyl group, an arylene group, a divalent heterocyclic group, a group represented by formula

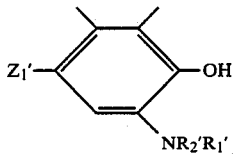

wherein $Z_1'$, $R_1'$, and $R_2'$ each is as defined in claim 2, and combinations of these divalent groups; $R_6$ represents a hydrogen atom or a group represented by —$X_2$—$R_8$, wherein $X_2$ represents a chemical bond or a divalent linking group selected from an amino group, an ether group, a thioether group, an alkylene group, an ethylene group, an imino group, a sulfonyl group, a sulfoxy group, a carbonyl group, and a combination of these divalent groups; and $R_8$ represents a substituted or unsubstituted aliphatic group, a substituted or unsubstituted aromatic group, or a substituted or unsubstituted heterocyclic group.

4. The silver halide color photographic material as claimed in claim 3, wherein $R_5$ represents a hydrogen atom; $Z_1$ represents a hydrogen atom, a halogen atom, an aryloxy group or an alkoxy group; the ring formed by $Q_1$ is a 5-membered to 8-membered ring; $R_6$ represents a hydrogen atom or an alkyl group; $R_1$ represents —CO—$R_7$ wherein $R_7$ represents a group selected from a substituted or unsubstituted aliphatic group having from 1 to 32 carbon atoms, a substituted or unsubstituted aryl group, a substituted or unsubstituted heterocyclic group, a substituted or unsubstituted aromatic amino group, a substituted or unsubstituted heterocyclic amino group and a substituted or unsubstituted aliphatic oxy group; $R_2$ represents a hydrogen atom; $R_3$ represents a substituted alkyl group, a substituted or unsubstituted phenyl group, or a substituted phenylamino group; and $R_4$ represents a substituted or unsubstituted alkyl group or a substituted or unsubstituted phenyl group.

5. The silver halide color photographic material as claimed in claim 4, wherein $Z_1$ represents a chlorine atom, the ring formed by a $Q_1$ is a 5-membered to 7-membered ring; and $R_6$ represents a hydrogen atom.

6. The silver halide color photographic material as claimed in claim 1, wherein each said polymer comprising coupler moieties represented by formula (I) or (II) comprises a repeating unit represented by the following formula (T):

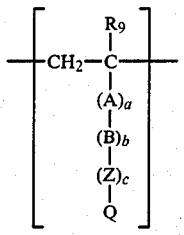

(T)

wherein $R_9$ represents a hydrogen atom, an alkyl group having from 1 to 4 carbon atoms or a chlorine atom; A represents —CONH—, —COO— or a substituted or unsubstituted phenylene group; B represents a substituted or unsubstituted alkylene group, a substituted or unsubstituted phenylene group or a substituted or unsubstituted aralkylene group; Z represents —CONH—, —NHCONH—, —NHCO—, —NHCO—, —OCONH—, —NH—, —COO—, —OCO—, —CO—, —O—, —$SO_2$—, —$NHSO_2$— or —$SO_2$NH—; a, b and c, which may be the same or different, each represents 0 or 1; and Q represents said coupler moiety represented by formula (I) or (II).

7. The silver halide color photographic material as claimed in claim 6, wherein said dimer formed by two coupler moieties represented by formula (I) are formed by a linkage of $Q_1$ or $R_1$; and said polymer formed by coupler moieties represented by formula (II) are formed by a linkage of $Z_1$ or $R_1$.

8. The silver halide color photographic material as claimed in claim 1, wherein said couplers represented by formulae (I) and (II) are present in a total amount of from about 0.1 to 1.0 mol per mol of silver halide contained in said light-sensitive material.

9. The silver halide color photographic material as claimed in claim 8, wherein said couplers represented by formulae (I) and (II) are present in a total amount of from about 0.1 to 0.5 mol per mol of silver halide contained in said light-sensitive material.

10. The silver halide color photographic material as claimed in claim 1, wherein said coupler represented by formula (I) is present in an amount of from about 5 to 95 mol% based on the total amount of said couplers represented by formulae (I) and (II) in said material.

11. The silver halide color photographic material as claimed in claim 10, wherein said coupler represented by formula (I) is present in an amount of from about 20 to 80 mol% based on the total amount of said couplers represented by formulae (I) and (II) in said material.

* * * * *